US011109174B2

(12) United States Patent
Maeno et al.

(10) Patent No.: US 11,109,174 B2
(45) Date of Patent: Aug. 31, 2021

(54) SOUND FIELD FORMING APPARATUS AND METHOD

(71) Applicant: SONY CORPORATION, Tokyo (JP)

(72) Inventors: Yu Maeno, Tokyo (JP); Masafumi Takahashi, Tokyo (JP); Yuhki Mitsufuji, Tokyo (JP)

(73) Assignee: SONY CORPORATION, Tokyo (JP)

( * ) Notice: Subject to any disclaimer, the term of this patent is extended or adjusted under 35 U.S.C. 154(b) by 0 days.

(21) Appl. No.: 16/314,258

(22) PCT Filed: Jun. 21, 2017

(86) PCT No.: PCT/JP2017/022773
§ 371 (c)(1),
(2) Date: Dec. 28, 2018

(87) PCT Pub. No.: WO2018/008395
PCT Pub. Date: Jan. 11, 2018

(65) Prior Publication Data

US 2019/0327573 A1 Oct. 24, 2019

(30) Foreign Application Priority Data

Jul. 5, 2016 (JP) ..... JP2016-133049

(51) Int. Cl.
*H04S 7/00* (2006.01)
*H04R 1/40* (2006.01)

(52) U.S. Cl.
CPC ..... *H04S 7/303* (2013.01); *H04R 1/403* (2013.01)

(58) Field of Classification Search
CPC ..... H04S 7/303; H04S 7/302; H04R 1/403; H04R 1/323

(Continued)

(56) References Cited

U.S. PATENT DOCUMENTS

2004/0131338 A1* 7/2004 Asada ..... H04R 3/12 386/239
2005/0117753 A1* 6/2005 Miura ..... H04R 3/12 381/17

(Continued)

FOREIGN PATENT DOCUMENTS

AT 352177 T 2/2007
AU 2004250746 A1 12/2004

(Continued)

OTHER PUBLICATIONS

International Search Report and Written Opinion of PCT Application No. PCT/JP2017/022773, dated Aug. 8, 2017, 10 pages of ISRWO.

(Continued)

*Primary Examiner* — Vivian C Chin
*Assistant Examiner* — Douglas J Suthers
(74) *Attorney, Agent, or Firm* — Chip Law Group

(57) ABSTRACT

Provided is a sound field forming apparatus and method to improve reproducibility of a wave front by using a smaller amount of computation. The sound field forming apparatus includes a listener position acquisition section that acquires listener positional information indicating a position of a listener, a drive speaker selection section that selects one or a plurality of speakers, as a drive speaker, used to form a sound field, among the speakers configuring a speaker array on the basis of the listener positional information, and a drive signal generation section that drives the drive speaker and generates a speaker drive signal for forming the sound field in accordance with a selection result of the drive speaker.

9 Claims, 10 Drawing Sheets

(58) Field of Classification Search
USPC ..... 381/303
See application file for complete search history.

(56) References Cited

U.S. PATENT DOCUMENTS

| | | | | |
|---|---|---|---|---|
| 2006/0098830 | A1* | 5/2006 | Roeder | H04S 3/002 381/310 |
| 2009/0087000 | A1 | 4/2009 | Ko | |
| 2010/0182231 | A1 | 7/2010 | Morimiya et al. | |
| 2011/0103620 | A1 | 5/2011 | Strauss et al. | |

FOREIGN PATENT DOCUMENTS

| | | | |
|---|---|---|---|
| CA | 2530626 | A1 | 12/2004 |
| CN | 1826838 | A | 8/2006 |
| CN | 1898943 | A | 1/2007 |
| DE | 10328335 | A1 | 1/2005 |
| DE | 102007032272 | A1 | 1/2009 |
| EP | 1637012 | A1 | 3/2006 |
| EP | 2056627 | A1 | 5/2009 |
| JP | 2005-167612 | A | 6/2005 |
| JP | 2006-246310 | A | 9/2006 |
| JP | 2007-081929 | A | 3/2007 |
| JP | 2007-507121 | A | 3/2007 |
| JP | 2008-219562 | A | 9/2008 |
| JP | 2008-227803 | A | 9/2008 |
| JP | 4338733 | B2 | 10/2009 |
| JP | 2010-170166 | A | 8/2010 |
| JP | 2013-510480 | A | 3/2013 |
| JP | 2014-161111 | A | 9/2014 |
| KR | 10-2005-0053313 | A | 6/2005 |
| KR | 10-2006-0019610 | A | 3/2006 |
| KR | 10-0719816 | B1 | 5/2007 |
| KR | 10-2009-0033717 | A | 4/2009 |
| WO | 2004/114725 | A1 | 12/2004 |
| WO | 2008/041530 | A1 | 4/2008 |
| WO | 2016/180493 | A1 | 11/2016 |

OTHER PUBLICATIONS

Extended European Search Report of EP Application No. 17824002.4, dated May 16, 2019, 06 pages.

Kamakura, et al., "Practical Development of a Parametric Loudspeaker", The Journal of the Acoustical Society of Japan, vol. 62, Issue 11, pp. 791-797 pages.

Kamakura; et al., "Practical Development of a Parametric Loudspeaker", The Journal of the Acoustical Society of Japan, vol. 62, No. 11 (2006), pp. 791-797.

Office Action for EP Patent Application No. 17824002.4, dated Oct. 14, 2020, 05 pages of Office Action.

Office Action for CN Patent Application No. 201780040469.X, dated Apr. 6, 2021, 11 pages of English Translation and 11 pages of Office Action.

Office Action for KR Patent Application No. 10-2018-7036875 dated Mar. 31, 2021, 4 pages of Office Action and 4 pages of English Translation.

Office Action for JP Patent Application No. 2018-526013, dated Jun. 8, 2021, 04 pages of English Translation and 04 pages of Office Action.

* cited by examiner

SOUND FIELD FORMING APPARATUS AND METHOD

CROSS REFERENCE TO RELATED APPLICATIONS

This application is a U.S. National Phase of International Patent Application No. PCT/JP2017/022773 filed on Jun. 21, 2017, which claims priority benefit of Japanese Patent Application No. JP 2016-133049 filed in the Japan Patent Office on Jul. 5, 2016. Each of the above-referenced applications is hereby incorporated herein by reference in its entirety.

TECHNICAL FIELD

The present technology relates to a sound field forming apparatus and method, and a program, and in particular, relates to a sound field forming apparatus and method, and a program, enabled to improve reproducibility of a wave front by using a smaller amount of computation.

BACKGROUND ART

For example, in the case where listeners exist in a space and each listener is allowed to hear different sounds, each of the plurality of listeners can listen to different sound by using directivity control technology.

As a method for performing such directivity control, a method for using a parametric speaker is known (for example, refer to NPL 1).

In reality, in a method for using a parametric speaker, parametric speakers must be prepared for the number of directions of proposed sound. Further, a sound field cannot be controlled in a depth direction toward the parametric speaker. In addition, a particular sound field such as a point sound source or a plane wave cannot be formed. As compared to a normal speaker, quality of sound output from the parametric speaker is not preferable, and therefore reproduced content is limited.

By contrast, by using a speaker array, a direction of directivity or the number of reproduced sounds can be adaptively changed by signal processing. Further, in addition to the directivity control, a point sound source or plane wave can be formed by wave front synthesis technology. By using the sound field formation, a particular sound field can be provided for a particular listener.

CITATION LIST

Non-Patent Literature

[NPL 1]
Kamakura et al., "Practical use of the parametric speaker," Acoustical Society of Japan Journal, vol. 62, p. 791-797, 2006.

SUMMARY

Technical Problems

Meanwhile, in a sound field formation using a speaker array, more speakers are normally used to thereby increase reproducibility of the sound field.

However, in the case where different sound fields are provided for each of the plurality of listeners, a wave front generated to allow each listener to hear sound interferes with each other to decrease reproducibility of the wave front. Further, not only sound reproduced for the listener but also sound reproduced for other listeners is leaked and heard. Further, in a case where the number of the speakers configuring the speaker array increases, the amount of computation of convolution processing increases for the number of the increased speakers.

The present technology is performed by considering such a situation, and can improve reproducibility of a wave front by using a smaller amount of computation.

Solution to Problems

According to an aspect of the present technology, a sound field forming apparatus includes: a listener position acquisition section configured to acquire listener positional information indicating a position of a listener, a drive speaker selection section configured to select one or a plurality of speakers, as a drive speaker, used to form a sound field, among the speakers configuring a speaker array on the basis of the listener positional information, and a drive signal generation section configured to drive the drive speaker and generate a speaker drive signal for forming the sound field in accordance with a selection result of the drive speaker.

The speaker drive signal may be a signal for forming the sound field by wave front synthesis.

The drive signal generation section may convolute a filter coefficient and a sound source signal and generate the speaker drive signal only regarding the drive speaker of the speakers configuring the speaker array.

The sound field forming apparatus may further include: a filter coefficient recording section configured to record the filter coefficient of each of the speakers configuring the speaker array.

The drive speaker selection section may select a speaker positioned near to the listener as the drive speaker in a direction parallel to the speaker array.

The drive speaker selection section may select a speaker positioned near to a sound source generated by forming the sound field as the drive speaker in a direction parallel to the speaker array.

The drive speaker selection section may select the drive speaker so that as the listener exists in a position more distant from the speaker array, the number of the drive speakers becomes larger in a direction vertical to the speaker array.

The drive speaker selection section may select the drive speaker so that as the number of the listeners or listener groups is larger, the number of the drive speakers that are selected regarding the listener or the listener group becomes smaller in the case where the drive speaker is selected in each of the listeners or in each of the listener groups.

The drive speaker selection section may select the drive speaker in accordance with a forming system of the sound field.

A sound field forming method or program according to an aspect of the present technology includes the steps of: acquiring listener positional information indicating a position of a listener, selecting one or a plurality of speakers, as a drive speaker, used to form a sound field, among the speakers configuring a speaker array on the basis of the listener positional information, and driving the drive speaker and generating a speaker drive signal for forming the sound field in accordance with a selection result of the drive speaker.

According to an aspect of the present technology, listener positional information indicating a position of a listener is acquired, one or a plurality of speakers used to form a sound field among the speakers configuring a speaker array are selected as a drive speaker on the basis of the listener positional information, and the drive speaker is driven and a speaker drive signal for forming the sound field is generated in accordance with a selection result of the drive speaker.

Advantageous Effect of Invention

According to an aspect of the present technology, reproducibility of a wave front can be improved by using a smaller amount of computation.

Note that, the effect described here is not necessarily limited, and may be any of the effects described within the present disclosure.

DESCRIPTION OF EMBODIMENTS

Hereinafter, embodiments to which the present technology is applied will be described by referring to the figures.

First Embodiment

<Regarding the Present Technology>

The present technology selects a speaker that is driven from among speakers configuring a speaker array in accordance with a position of a listener, the number of the listeners, and a forming system of a sound field. A formed sound field can be allowed to decrease an influence on other sound fields and reproducibility of a wave front can be allowed to be improved by using a smaller amount of computation.

To form the sound field for reproducing sound that a certain listener is allowed to hear, for example, only some speakers are used and all the speakers configuring the speaker array are not driven. In this case, the amount of computation of convolution processing required to generate a speaker drive signal can be reduced.

Further, even if all the speakers are not used to form the sound field, when the speakers arrayed in a sufficient length are used, a wave front of sound can be formed with sufficient reproducibility. That is, a wave front in which an error between a practically formed wave front and an ideal wave front is sufficiently decreased can be formed.

Figure 1:
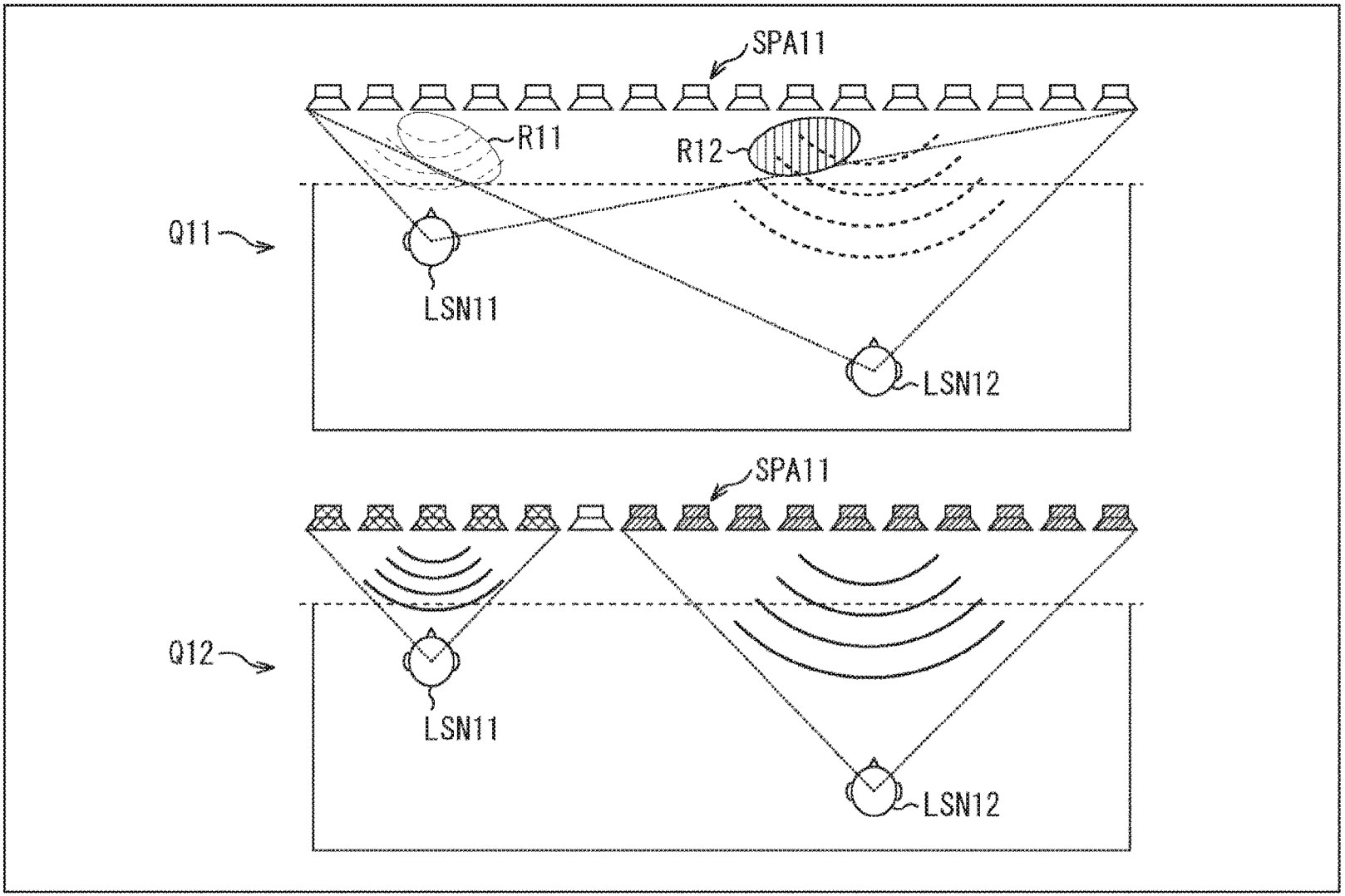
FIG. 1 is a diagram describing the present technology.

As illustrated in FIG. 1, for example, a listener LSN11 and a listener LSN12 exist in a listening area. By using a speaker array SPA11, each of the listeners is assumed to be allowed to hear different sounds by wave front synthesis. Specifically, the listener LSN11 is assumed to be allowed to hear sound of a content A and the listener LSN12 is assumed to be allowed to hear sound of a content B.

At this time, as illustrated by an arrow Q11, for example, all speakers configuring the speaker array SPA11 are assumed to be driven to form a wave front of sound of the content A. At the same time, all the speakers configuring the speaker array SPA11 are assumed to be driven to form a wave front of sound of the content B.

In such a case, an amplitude in the wave front of the sound of the content B is sufficiently large, for example, even in an area R11 in a position near to the listener LSN11. Therefore, the wave front of the sound of the content A receives an influence by the wave front of the sound of the content B. As a result, reproducibility in the wave front of the sound of the content A is reduced. Specifically, the wave front of the sound of the content A and the wave front of the sound of the content B interfere with each other.

In this case, the sound of the content A reproduced to itself is heard to the listener LSN11. Also, the sound of the content B reproduced to the listener LSN12 is leaked and heard to the listener LSN11.

Similarly, an amplitude in the wave front of the sound of the content A is sufficiently large, for example, even in an area R12 in a position near to the listener LSN12. Therefore, the wave front of the sound of the content B receives an influence by the wave front of the sound of the content A. As a result, reproducibility in the wave front of the sound of the content B is reduced.

To solve the above problem, in the present technology, for example, as illustrated by an arrow Q12, a speaker used to form the wave front of sound of each content is selected from among the speakers configuring the speaker array SPA11.

In this example, among the speakers configuring the speaker array SPA11, only five speakers arrayed on the left side in the figure are driven and the wave front of the sound of the content A is formed. Further, among the speakers configuring the speaker array SPA11, only ten speakers arrayed on the right side in the figure are driven and the wave front of the sound of the content B is formed.

This can suppress the wave front of the sound of the content A and the wave front of the sound of the content B from interfering with each other. Further, this can improve reproducibility of the wave front of sound at the time of forming the sound field. That is, an error between the practically formed wave front and an ideal wave front can be reduced.

When the wave fronts of the sound of the content A and the content B are formed, some speakers configuring the speaker array SPA11 are used. When an array length of the speaker array including the speakers is sufficiently long, the wave front can be formed with sufficient reproducibility.

In the wave front synthesis, normally, a speaker is assumed to have monopole characteristics, specifically, omnidirectional characteristics in which a wave front of sound evenly spreads in all directions. However, an error is present in practical characteristics of speakers. Particularly, as a speaker is more located in an edge of the speaker array when viewed from a listener, disjunction from the monopole characteristics becomes larger, and therefore an error is caused in the formed sound field. By driving only necessary speakers, an influence of an error of the speaker characteristics can be reduced and reproducibility of the wave front can be improved.

In addition, only the necessary speakers are driven and thereby the amount of computation of the convolution processing can be reduced as compared with a case of using all the speakers configuring the speaker array SPA11.

For example, in the case where all the speakers configuring the speaker array SPA11 are driven to generate a point sound source, a filter coefficient is required for (the number of channels)×(the number of positions of the point sound source) in a case where using a speaker as a channel. However, only the necessary speakers are selectively driven and thereby the number of filter coefficients used for computation can be reduced for the above. The process permits the amount of computation of the convolution processing to be reduced.

Figure 2:
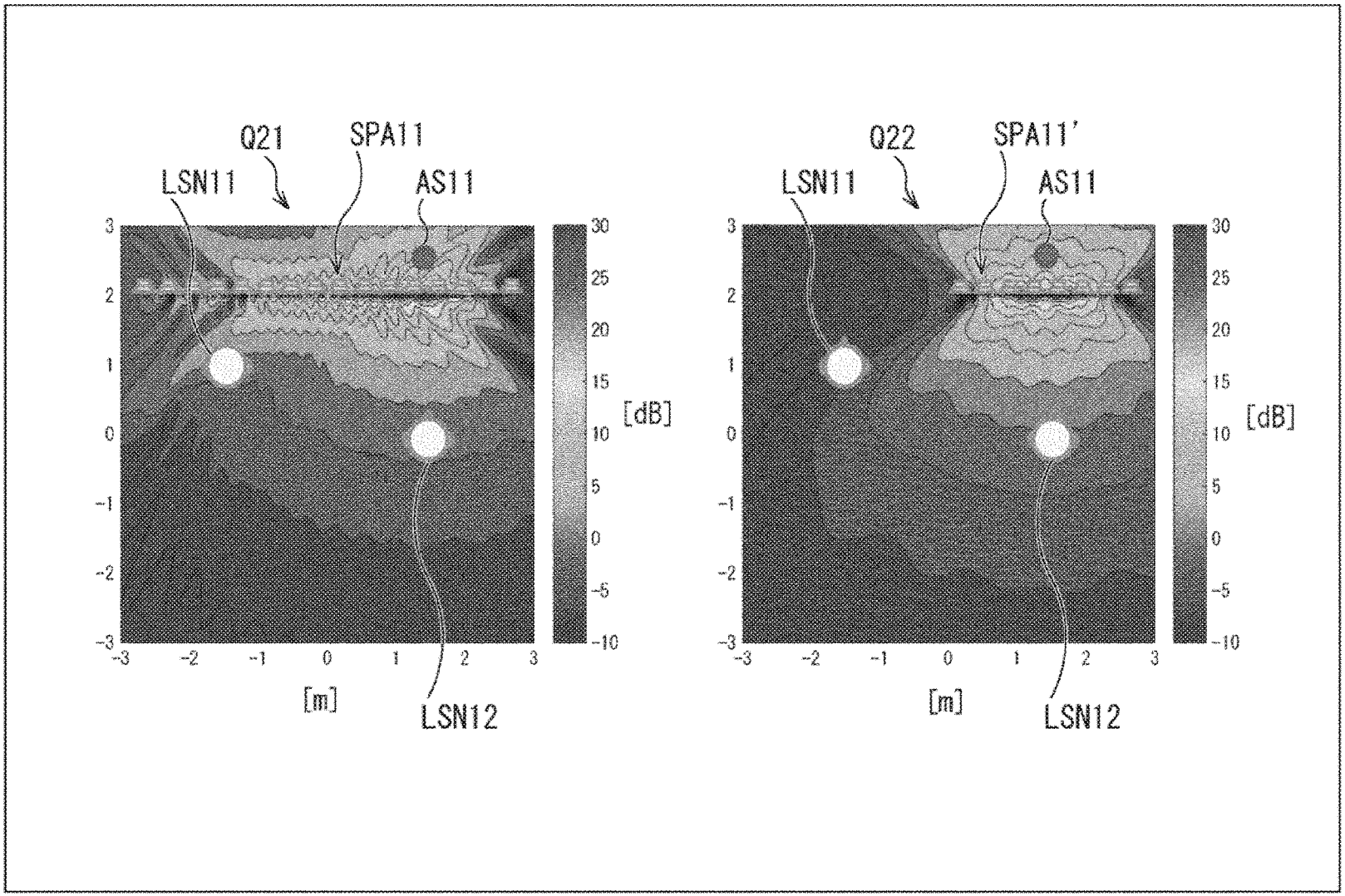
FIG. 2 is a diagram describing the present technology.

As illustrated in FIG. 2, for example, a sound field formation is assumed to be performed so as to generate a predetermined sound source AS11 by using the speaker array SPA11. Note that, the same reference numerals are attached in FIG. 2 to the portions corresponding to the case in FIG. 1, and a description of these will be arbitrarily omitted. Further, in FIG. 2, contrasting density of each position indicates a sound pressure of the formed sound field.

As illustrated by an arrow Q21 in FIG. 2, it is assumed that all the speakers configuring the speaker array SPA11 are driven and a sound field in which the sound of the content B is reproduced is formed. In the content B, a sound source of the sound is the sound source AS11 and the sound source AS11 is located at the front of the listener LSN12 that is allowed to hear the sound of the content B.

In this case, a sufficient sound pressure is secured in a position of the listener LSN12 and the listener LSN12 can hear the sound of the content B with sufficient sound volume. However, since the sound pressure is sufficiently large even in a position of the listener LSN11, the sound of the content B that is essentially unintended is heard even by the listener LSN11.

By contrast, only speakers that are located on the right side in the figure, specifically, on the side of the listener LSN12 or the sound source AS11 are assumed to be driven among the speakers configuring the speaker array SPA11 as illustrated by an arrow Q22. Further, a speaker array including the speakers is assumed to be used as the speaker array SPA11'. In this case, it is understood that the sound of the content B is heard with a sufficient sound pressure by the listener LSN12 and the sound pressure is low in a position of the listener LSN11 and the sound of the content B is hardly heard by the listener LSN11.

As described above, in the case where each of a plurality of listeners is allowed to hear different sounds, only some speakers are selectively driven in each listener from among the speakers configuring the speaker array to thereby improve the reproducibility of the wave front of sound by using the smaller amount of computation.

<Configuration Example of Sound Field Forming Apparatus>

Continuously, a specific embodiment according to the present technology described above will be described.

Figure 3:
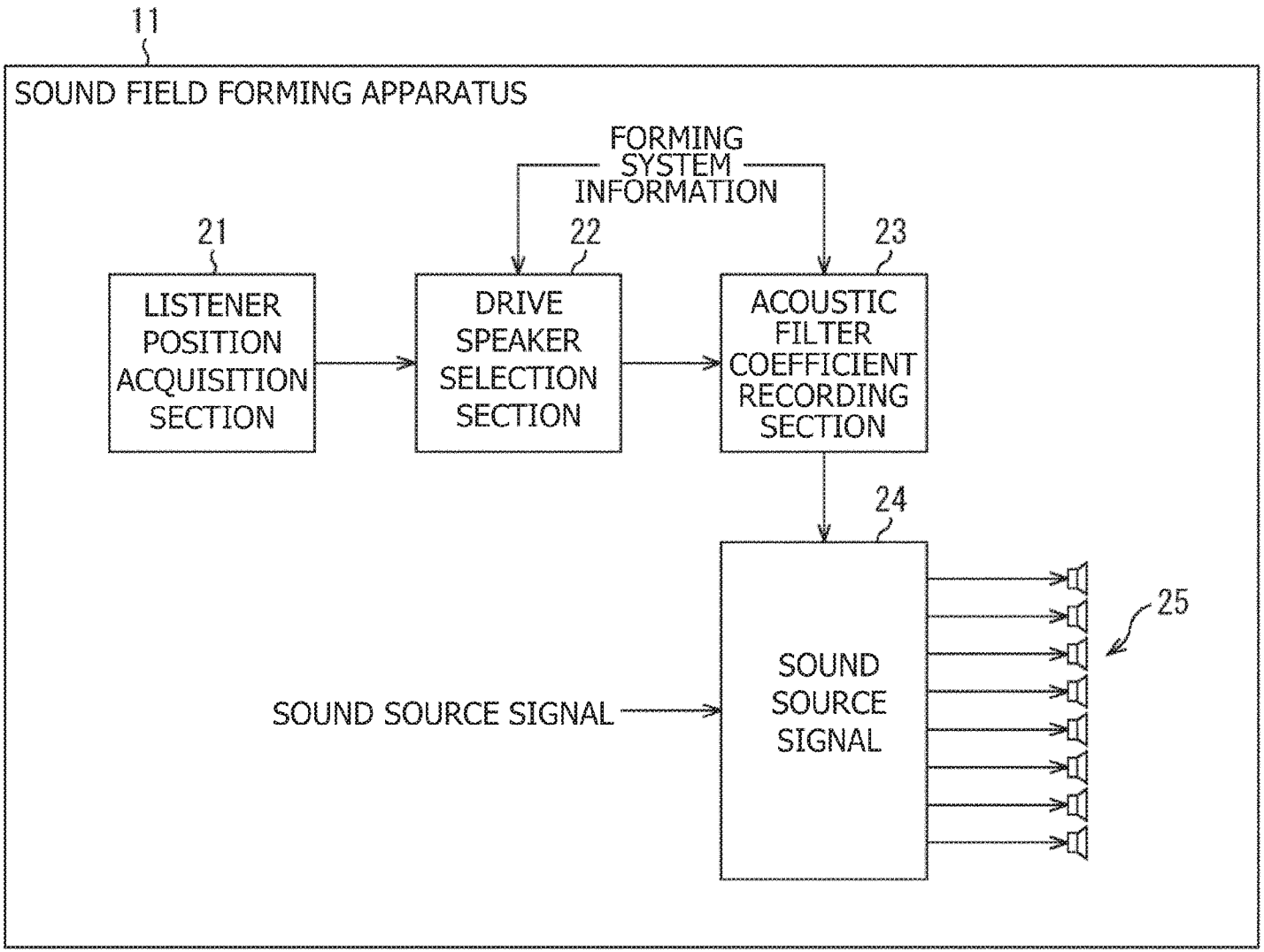
FIG. 3 is a diagram illustrating a configuration example of a sound field forming apparatus.

FIG. 3 is a diagram illustrating a configuration example of a sound field forming apparatus to which the present technology is applied.

The sound field forming apparatus 11 illustrated in FIG. 3 has a listener position acquisition section 21, a drive speaker selection section 22, an acoustic filter coefficient recording section 23, an acoustic filter section 24, and a speaker array 25.

The listener position acquisition section 21 acquires listener positional information indicating a position of the listener that exists in the listening area that is a space for forming the sound field and supplies the listener positional information to the drive speaker selection section 22.

The drive speaker selection section 22 selects a speaker used to form the sound field among speakers configuring the speaker array 25, that is, a speaker that is driven on the basis of the listener positional information supplied from the listener position acquisition section 21 and forming system information indicating the forming system of the sound field supplied from the outside. Further, the drive speaker selection section 22 generates drive speaker information indicating a selection result of a speaker that is driven and supplies the drive speaker information to the acoustic filter coefficient recording section 23. Hereinafter, a speaker used to form the sound field, which is selected by the drive speaker selection section 22, is also referred to as a drive speaker.

Here, from among the speakers configuring the speaker array 25 in each listener or in each group (listener group) including the plurality of listeners, one or the plurality of speakers used to form the wave front of sound that the listener or group is allowed to hear, that is, the proposed sound field are selected as the drive speaker. Further, information indicating the selected drive speaker is generated as the drive speaker information.

Note that, hereinafter, for ease of description, the drive speaker is assumed to be selected in each listener and its descriptions are continued.

The acoustic filter coefficient recording section 23 records in advance a filter coefficient of an acoustic filter for forming a predetermined sound field in each forming system of the sound field.

The acoustic filter coefficient recording section 23 selects a filter coefficient used to form the sound field from among a plurality of filter coefficients recorded in advance on the basis of the forming system information supplied from the outside and the drive speaker information supplied from the drive speaker selection section 22 and supplies the filter coefficient to the acoustic filter section 24.

To the acoustic filter section 24, a sound source signal of sound to be reproduced is supplied. Specifically, in the case where sound of different contents is allowed to be heard, for example, by each listener in the listening area, the sound source signal for reproducing sound of the content is supplied to the acoustic filter section 24 in each of the contents. Further, in the case where sound of the same content is allowed to be heard at different timing, for example, by each of the plurality of listeners, the sound source signal for reproducing sound of one content is supplied to the acoustic filter section 24.

In each drive speaker, the acoustic filter section 24 convolutes the sound source signal supplied from the outside and the filter coefficient supplied from the acoustic filter coefficient recording section 23, generates the speaker drive signal for forming a desired sound field, and supplies the speaker drive signal to the speaker array 25. Specifically, in accordance with a selection result of the drive speaker by the drive speaker selection section 22, the acoustic filter section 24 functions as a drive signal generation section that performs the convolution processing of the sound source signal and the filter coefficient and generates the speaker drive signal only in the drive speaker of the speakers configuring the speaker array 25.

The speaker drive signal generated as described above is, for example, a signal for driving the drive speaker and forming a desired sound field by the wave front synthesis.

Examples of the speaker array 25 include a linear speaker array in which a plurality of speakers are arrayed linearly, a plane speaker array in which the plurality of speakers are arrayed in a planar manner, a cyclic speaker array in which the plurality of speakers are arrayed circularly, a spherical speaker array in which the plurality of speakers are arrayed spherically, and the like. Note that, when the speaker array 25 is obtained by arraying the plurality of speakers, any speaker array may be accepted.

The speaker array 25 forms the sound field by reproducing sound on the basis of the speaker drive signal supplied from the acoustic filter section 24. Specifically, more particularly, each drive speaker of the speaker array 25 outputs sound on the basis of the supplied speaker drive signal and thereby, for example, the sound field is formed by the wave front synthesis.

Figure 4:
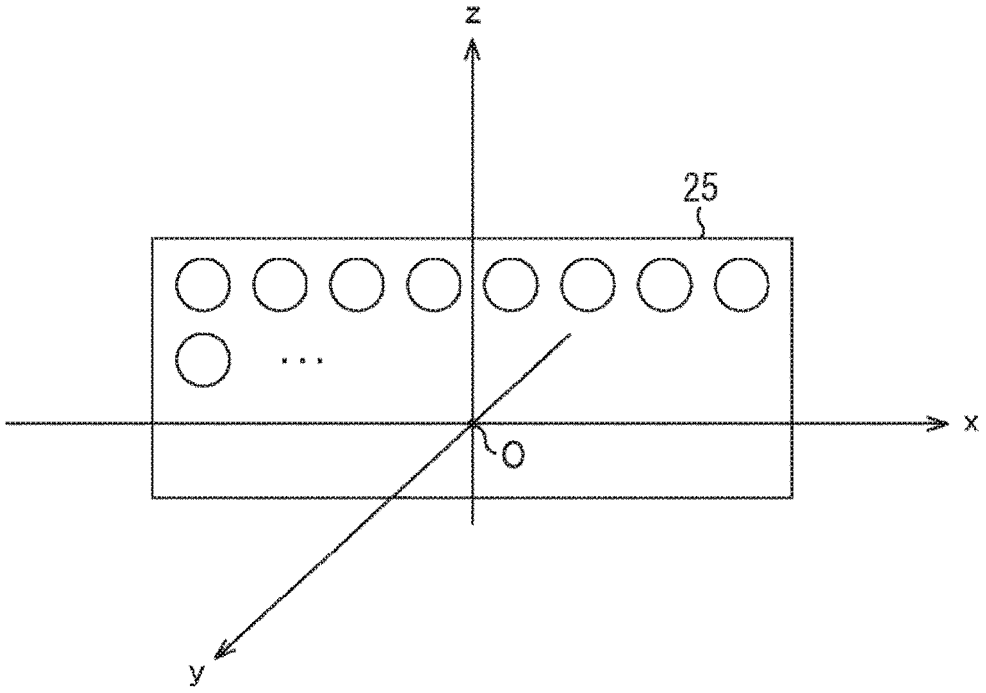
FIG. 4 is a diagram describing a coordinate system.

Here, a coordinate system used in the following descriptions will be described with reference to FIG. 4. Note that, the same reference numerals are attached in FIG. 4 to the portions corresponding to the case in FIG. 3, and a description of these will be arbitrarily omitted.

That is, in the following descriptions, a center position of the speaker array 25 is defined as an origin O of a three-dimensional orthogonal coordinate system.

Further, three axes of the three-dimensional orthogonal coordinate system are defined as an x-axis, y-axis and z-axis that pass through the origin O and are orthogonal to each other. Here, a direction of the x-axis, namely, an x direction is defined as a direction in which the speakers configuring the speaker array 25 are arrayed. Further, a direction of the y-axis, namely, a y direction is defined as a direction vertical to the x direction and parallel to a direction in which a sound wave is output from the speaker array 25. Further, a direction vertical to the x direction and y direction is defined as a direction of a z-axis, namely, a z direction. Particularly, a direction in which a sound wave is output from the speaker array 25 is defined as a positive direction of the y direction.

Hereinafter, a position in a space, specifically, a vector indicating a position in the space is assumed to be also written as (x, y, z) by using an x coordinate, a y coordinate, and a z coordinate. Further, a position indicated by coordinates (x, y, z) is assumed to be also referred to as a position v.

Further, the speaker array 25 may be any speaker array such as a linear speaker array, a plane speaker array, a cyclic speaker array, a spherical speaker array, and the like. Hereinafter, the speaker array 25 is assumed to be a linear speaker array and its descriptions are continued.

(Listener Position Acquisition Section)

Next, each section of the sound field forming apparatus 11 illustrated in FIG. 3 will be described in detail. First, the listener position acquisition section 21 will be described.

The listener position acquisition section 21 acquires information indicating a position of a listener as the listener positional information, for example, in each listener in the listening area.

For example, the listener position acquisition section 21 may acquire information indicating a position of a listener that is supplied from an external apparatus or input by a user etc., as the listener positional information.

Further, for example, the listener position acquisition section 21 detects the number of listeners and positions of the listeners and generates information indicating a position of a listener for each listener. Through the process, the listener position acquisition section 21 may acquire the information as the listener positional information.

In such a case, the listener position acquisition section 21 is configured, for example, by a camera that photographs listeners as a subject, a pressure sensing sensor that is arranged in a floor portion of the space in which the listener exists, a distance sensor that detects a distance up to the listener by ultrasonic waves etc., and the like. In this case, the listener position acquisition section 21 recognizes the listener by using the camera, the pressure sensing sensor, the distance sensor, and the like and calculates a position of the listener on the basis of recognition results thereof.

Specifically, for example, the listener position acquisition section 21 detects the listener by object recognition etc. using a dictionary from images photographed by the camera and generates the listener positional information indicating a position of each listener from detection results thereof.

Note that, in the case where a distance among the plurality of listeners is shorter than a predetermined constant distance, the listeners may be processed as a single group. In this case, a position of a typical listener belonging to the group, an average of the positions of respective listeners belonging to the group, or the like is set to the listener positional information at the time of qualifying the group as a single listener.

(Drive Speaker Selection Section)

The drive speaker selection section 22 selects a speaker that is driven from among the speakers configuring the speaker array 25 on the basis of the listener positional information and the forming system information.

Here, the forming system information is information indicating the forming system for forming the sound field. More particularly, the forming system information is, for example, information including information indicating a wave front forming method for forming the wave front of sound, specifically, a kind of a forming method of the sound field, a kind of the sound field for forming the point sound source or plane wave, and the like.

The drive speaker selection section 22 selects the drive speaker on the basis of the listener positional information and the forming system information. Further, the selection of the drive speaker is formed, for example, in the following manner.

Figure 5:
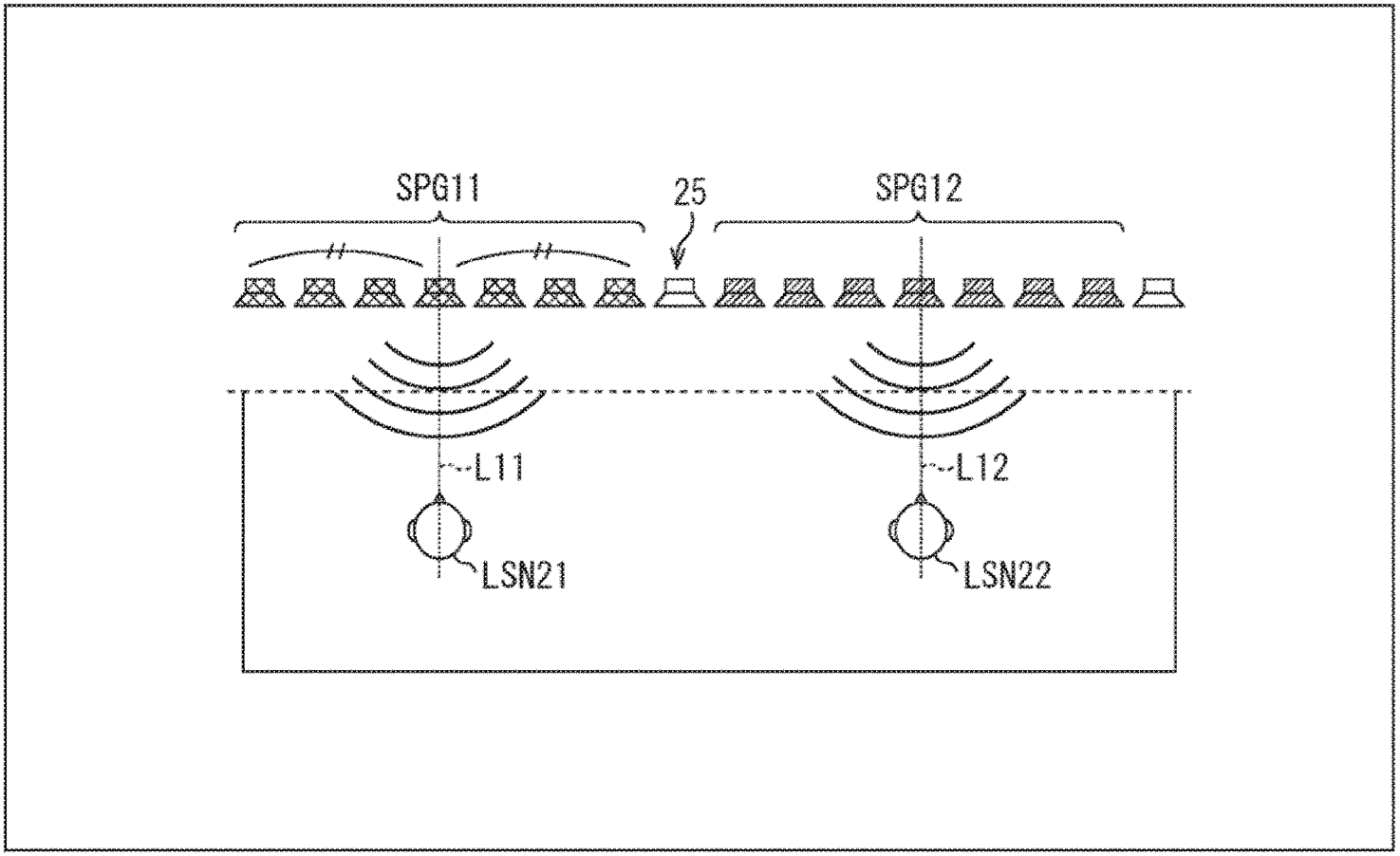
FIG. 5 is a diagram describing a selection of a drive speaker.

Specifically, as illustrated in FIG. 5, for example, a listener LSN21 and a listener LSN22 are assumed to exist at the front of the speaker array 25 in the listening area. Note that, the same reference numerals are attached in FIG. 5 to the portions corresponding to the case in FIG. 3, and a description of these will be arbitrarily omitted.

In the example, positions of the listener LSN21 and the listener LSN22 can be specified by using the listener positional information. In this case, regarding the listener LSN21, for example, the drive speaker selection section 22 finds out a straight line L11 in the y direction connecting the listener LSN21 and the speaker array 25. Further, the drive speaker selection section 22 sets a speaker nearest to an intersection point of the straight line L11 and the speaker array 25 as a central speaker.

Further, the drive speaker selection section 22 selects a predetermined number of speakers that are arrayed in the x direction centering on the central speaker, for example, the plurality of speakers as a speaker group SPG11 including the drive speakers regarding the listener LSN21.

The speaker group SPG 11 selected as described above is a speaker group including one or more symmetrical speakers that are positioned at the front of the listener LSN21, that is, centering on the speaker that is positioned in the y direction when viewed from the listener LSN21. In the example, speakers that are positioned near to the listener LSN21 in a direction parallel to the speaker array 25, that is, in the x direction are selected as the drive speaker.

As described above, the speakers that are positioned at the front of the listener LSN21, that is, the speakers that are positioned near to the listener LSN21 are used as the drive speaker. When the sound field that is proposed to the listener LSN21 by the wave front synthesis is formed, the wave front of sound can be formed with sufficiently high reproducibility in a position of the listener LSN21. Particularly, in the case where the wave front of sound is formed by using the speaker array, the reproducibility of the wave front becomes higher nearer to the center of the speaker array. Therefore, when the front of the listener LSN21 is set as a center position of the speaker array including the drive speakers, the reproducibility of the wave front can be improved.

Further, also regarding the listener LSN22, in the similar manner as in the listener LSN21, the drive speaker selection section 22 finds out the straight line L12 in the y direction connecting the listener LSN22 and the speaker array 25. Further, the drive speaker selection section 22 sets a speaker nearest to the intersection point of the straight line L12 and the speaker array 25 as the central speaker. Further, the drive speaker selection section 22 selects a predetermined number of speakers that are arrayed in the x direction centering on the central speaker as a speaker group SPG12 including the drive speakers regarding the listener LSN22.

Note that, here, speakers different in each listener are selected as each drive speaker of the listener LSN21 and the listener LSN22. Further, a single speaker may be used as the drive speaker of the plurality of listeners. By contrast, the drive speaker of each listener may be selected so that a single speaker is not selected as the drive speaker of the plurality of listeners. In such a case, sound that each listener is allowed to hear can be suppressed from interfering with each other and the reproducibility of the wave front of sound can be further improved.

Figure 6:
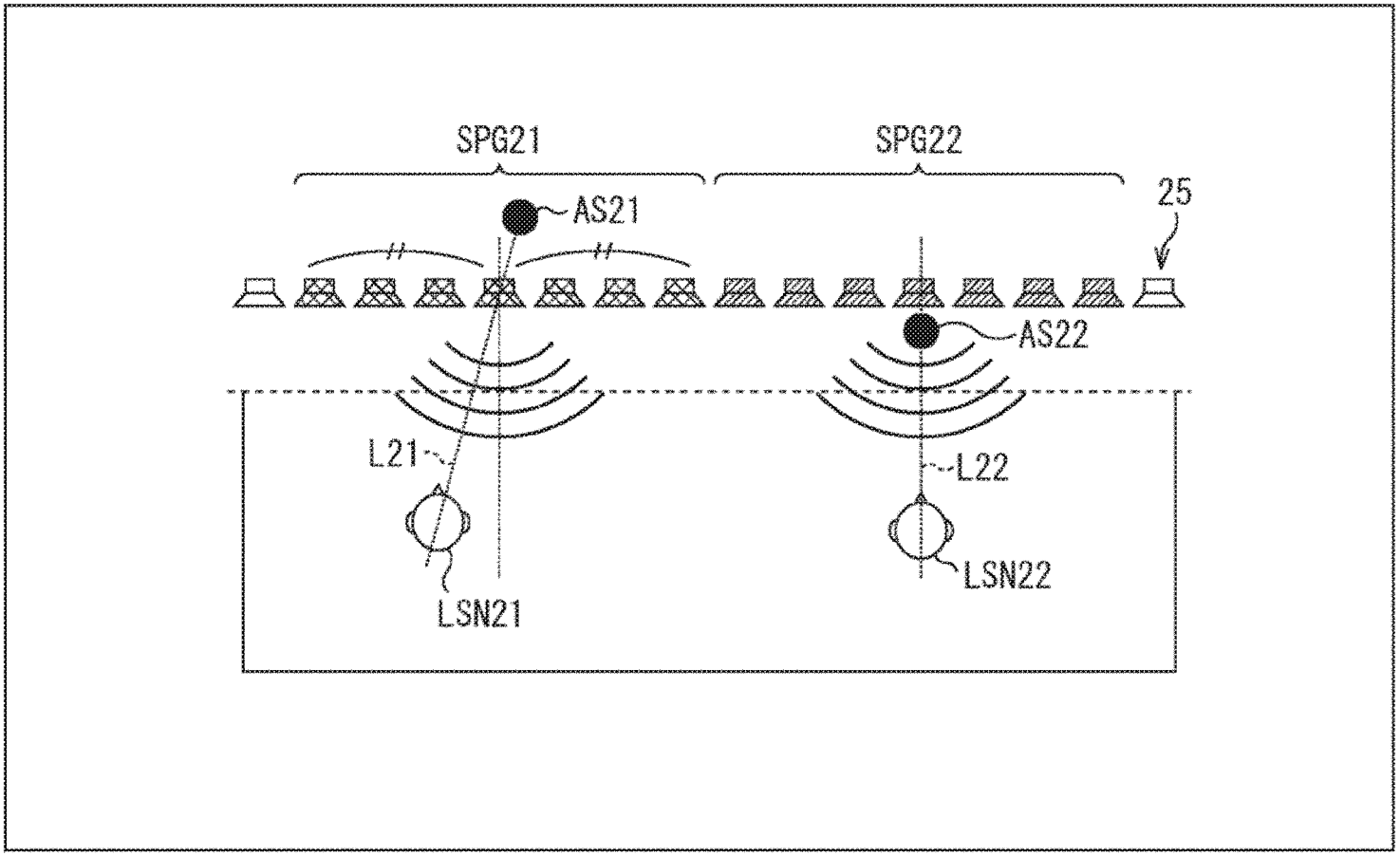
FIG. 6 is a diagram describing a selection of the drive speaker.

Further, as illustrated in FIG. 6, for example, while considering not only a position of the listener but also a position of the sound source generated at the time of forming the sound field, the selection of the drive speaker may be performed. Note that, the same reference numerals are attached in FIG. 6 to the portions corresponding to the case in FIG. 5, and a description of these will be arbitrarily omitted.

In the example, the listener LSN21 and the listener LSN22 are assumed to exist in the listening area. Further, it is assumed that a sound source AS21 is generated for the listener LSN21 at the time of forming the sound field and the listener LSN21 is allowed to hear sound of the sound source AS21. Further, it is assumed that a sound source AS22 is generated for the listener LSN22 at the time of forming the sound field and the listener LSN22 is allowed to hear sound of the sound source AS22. For example, positions of the sound source AS21 and the sound source AS22 may be set to a predetermined position. Alternatively, information indicating the positions of the sound sources may be included in the forming system information.

In such a case, regarding the listener LSN21, for example, the drive speaker selection section 22 finds out the straight line L21 connecting the listener LSN21 and the sound source AS21. Further, the drive speaker selection section 22 sets a speaker nearest to the intersection point of the straight line L21 and the speaker array 25 as the central speaker. Further, the drive speaker selection section 22 selects a predetermined number of speakers that are arrayed symmetrically in the x direction centering on the central speaker as a speaker group SPG21 including the drive speakers regarding the listener LSN21.

Accordingly, in this example, speakers that are positioned near to the listener LSN21 and the sound source AS21 in a direction parallel to the speaker array 25, that is, in the x direction are selected as the drive speaker.

The plurality of speakers are driven and the sound source AS21 is generated (formed) by the wave front synthesis. In this case, a contributing rate for generation of the sound source AS21 ought to be higher in a speaker in a position near to the sound source AS21. Consequently, speakers that are present in a position near to the listener LSN21 and the sound source AS21 are selected as the drive speaker. The process permits the wave front to be formed with sufficient reproducibility even a small number of speakers.

Further, also regarding the listener LSN22, in the similar manner as in the listener LSN21, the drive speaker selection section 22 finds out the straight line L22 connecting the listener LSN22 and the sound source AS22. Further, the drive speaker selection section 22 sets a speaker nearest to the intersection point of the straight line L22 and the speaker array 25 as the central speaker. Further, the drive speaker selection section 22 selects a predetermined number of speakers that are arrayed symmetrically in the x direction centering on the central speaker as a speaker group SPG22 including the drive speakers regarding the listener LSN22.

Note that, the number of the speakers that are selected as the drive speaker may be a predetermined number. Alternatively, there may be a valuable number that is determined in accordance with a distance in the y direction between the speaker array 25 and the listener, an inclination of a straight line connecting the sound source and a position of the listener, or the like. For example, as the inclination of the straight line connecting the sound source and a position of the listener is larger, more speakers are used as the drive speaker. In this case, an appropriate number of speakers can be selected to form the wave front with sufficient reproducibility. By contrast, for example, as a distance in the y direction between the listener and the speaker array 25 is shorter, the number of the drive speakers may be more decreased.

Further, a case in which the sound field is formed by the wave front synthesis is described here as an example. Further, the same sound may be output at the same time, for example, from the speaker selected as the drive speaker. This allows the amount of computation to be reduced when filter processing etc. are performed in each speaker at the time of generating the speaker drive signal. In addition, reproduced sound that a predetermined listener is allowed to hear and sound that other listeners are allowed to hear can be suppressed from being mixed.

Figure 7:
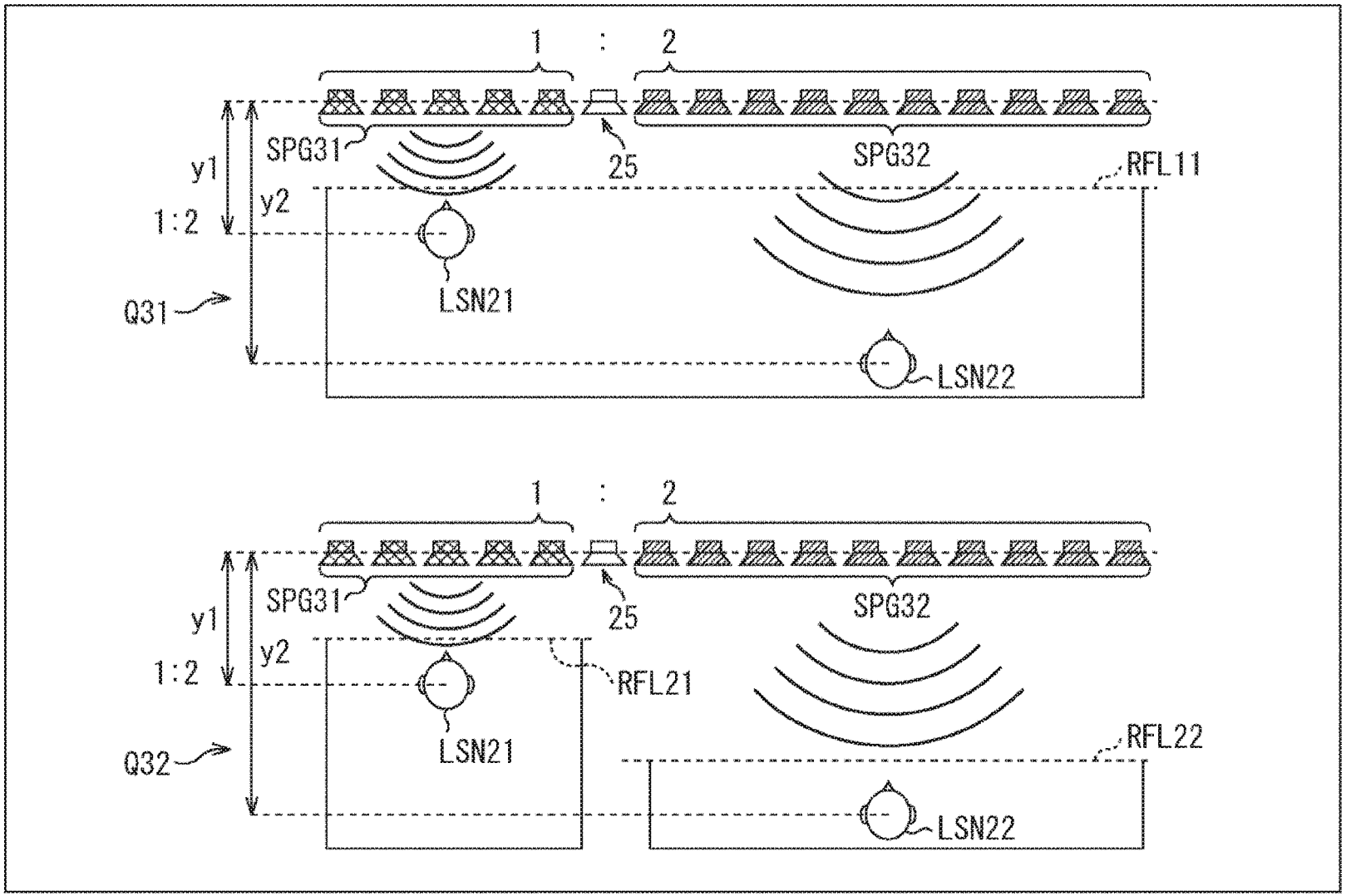
FIG. 7 is a diagram describing a selection of the drive speaker.

Further, as other example of a method for selecting the drive speaker, for example, as illustrated in FIG. 7, the drive speaker may be selected in accordance with a ratio of the distance in the y direction between the listener and the speaker array 25, that is, a ratio of the distance in a depth direction. Note that, the same reference numerals are attached in FIG. 7 to the portions corresponding to the case in FIG. 5, and a description of these will be arbitrarily omitted.

In an example illustrated by an arrow Q31 in FIG. 7, the listener LSN21 and the listener LSN22 exist in the listening area. A ratio of a distance y1 in the y direction from the speaker array 25 to the listener LSN21 and a distance y2 in the y direction from the speaker array 25 to the listener LSN22 is y1:y2=1:2.

Consequently, the drive speaker selection section 22 selects the drive speakers so that a ratio of the number of the drive speakers for forming the wave front of sound that the listener LSN21 is allowed to hear and the number of the drive speakers for forming the wave front of sound that the listener LSN22 is allowed to hear is equal to 1:2 that is a ratio of the distance y1 and the distance y2. Specifically, in the y direction that is a direction vertical to the speaker array 25, as a listener exists in a position that is more distant when viewed from the speaker array 25, the selection of the drive speakers is performed so as to more increase the number of the drive speakers selected regarding the listener.

In the example, five speakers that are present at the front of the listener LSN21 and are arrayed continuously in the x direction are selected as a speaker group SPG31 including the drive speakers regarding the listener LSN21. By contrast, ten speakers that are present at the front of the listener LSN22 and are arrayed continuously in the x direction are selected as a speaker group SPG32 including the drive speakers regarding the listener LSN22.

As described above, speakers in a position near to the listener are selected as the drive speaker. In addition, in accordance with a ratio of the distance from the speaker array 25 of each listener, the number of the drive speakers that are assigned to each listener is determined. The process permits the wave front to be formed with sufficient reproducibility in a position of each listener.

In the example, for example, a single reference line RFL11 is set to the listener LSN21 and the listener LSN22. The wave front synthesis is a technique for forming the sound field on the side more distant than the reference line RFL11 when viewed from the speaker array 25. Therefore, in this example, the reference line RFL11 is set near to the listener LSN21 that exists in a position nearer to the speaker array 25.

In the wave front synthesis, as the speaker array 25 is nearer to the reference line RFL11, the reproducibility of the wave front is higher. Therefore, even if a small number of the drive speakers are used against the listener LSN21 near to the reference line RFL11, the wave front can be formed with sufficient reproducibility.

By contrast, the listener LSN22 exists in a position distant from the reference line RFL11. Therefore, more drive speakers need to be used to secure the sufficient reproducibility of the wave front. Consequently, regarding the listener LSN22, speakers more than those of the listener LSN21 are used as the drive speaker.

Further, by the wave front synthesis, the sound source can be generated only on the speaker array side of the reference line. Consequently, when the sound source is generated near to each listener, or the like, the reference line may be specified in each listener, for example, as illustrated by an arrow Q32.

In this example, the reference line RFL21 is specified to the listener LSN21 and the reference line RFL22 is specified to the listener LSN22.

In this case, the speaker drive signal for forming the wave front of sound that the listener LSN21 is allowed to hear is generated with the reference line RFL21 used as a reference line. The speaker group SPG31 is driven on the basis of the speaker drive signal and the sound field proposed to the listener LSN21 is formed. Through the process, in a position of the listener LSN21, sound from the sound source generated near to its position is reproduced.

By contrast, the speaker drive signal for forming the wave front of sound that the listener LSN22 is allowed to hear is generated with the reference line RFL22 used as a reference line. The speaker group SPG32 is driven on the basis of the speaker drive signal and the sound field is formed.

The process permits the sound source to be generated near to the each listeners LSN21 and LSN22.

As the reference line is more distant from the speaker array 25, more drive speakers are required to form the wave front with sufficient reproducibility. Therefore, the reference line is set near to each listener and the sound source is generated near to each listener. In this case, the number of the drive speakers is determined on the basis of a ratio of the distance from the speaker array 25 to each listener. By doing so, an appropriate number of drive speakers can be used to each listener. The process permits the wave front of sound to be formed with sufficient reproducibility in a position of each listener.

For example, in the case where the speaker array 25 is a plane speaker array or the like, the drive speaker selection section 22 may select the drive speaker in accordance with a height of the head, that is, a height of the ears of each listener.

Specifically, for example, a speaker having the same height as that of a position of the ears of the listener is selected as the drive speaker. By doing so, even if two listeners in which a height of the position of the ears is different exist near to each other, sound for each listener can be suppressed from interfering with each other.

Figure 8:
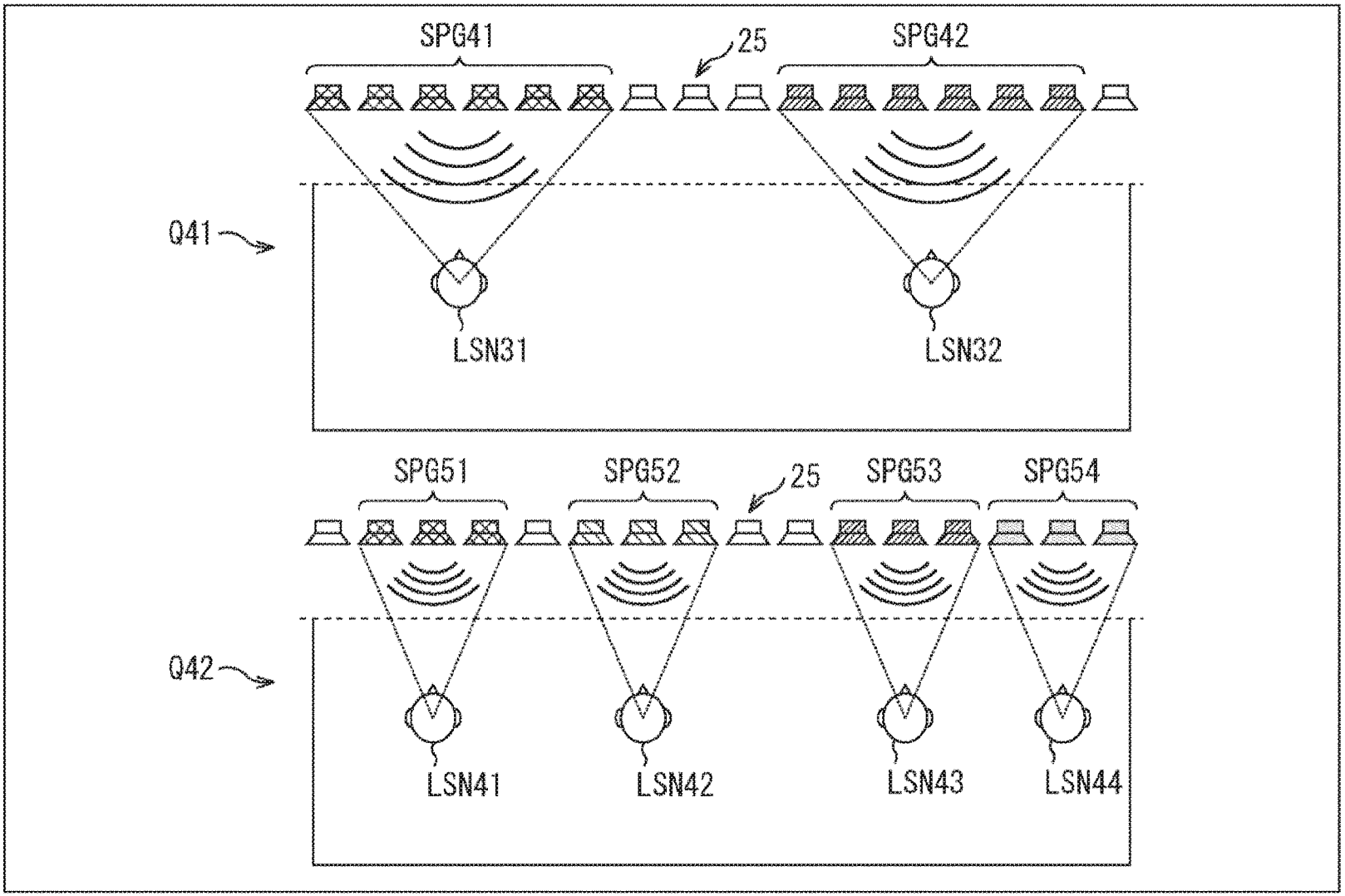
FIG. 8 is a diagram describing a selection of the drive speaker.

Further, in the case where the drive speaker is selected in each listener, the number of the drive speakers of each listener may be determined in accordance with the number of the listeners that exist in the listening area, for example, as illustrated in FIG. 8. Note that, the same reference numerals are attached in FIG. 8 to the portions corresponding to the case in FIG. 3, and a description of these will be arbitrarily omitted.

In an example illustrated by an arrow Q41, for example, a listener LSN31 and a listener LSN32 of two persons exist in the listening area. Note that, the drive speaker selection section 22 can specify the number of the listeners that exist in the listening area from the listener positional information.

In such a case, the drive speaker selection section 22 determines the number of speakers used as the drive speaker of each listener on the basis of "2" that is the number of the listeners in the listening area. In the example, six speakers are used as the drive speaker in each listener.

Specifically, the drive speaker selection section 22 selects six speakers that are present at the front of the listener LSN31 and are arrayed in the x direction as a speaker group SPG41 including the drive speakers regarding the listener LSN31. Similarly, the drive speaker selection section 22 selects six speakers that are present at the front of the listener LSN32 and are arrayed in the x direction as a speaker group SPG42 including the drive speakers regarding the listener LSN32.

Further, as illustrated by an arrow Q42, for example, a listener LSN41 to a listener LSN44 of four persons exist in the listening area. In such a case, the drive speaker selection section 22 determines the number of speakers used as the drive speaker of each listener on the basis of "4" that is the number of the listeners in the listening area. In this example, three speakers are used as the drive speaker in each listener.

Specifically, the drive speaker selection section 22 selects three speakers that are present at the front of the listener LSN41 and are arrayed in the x direction as a speaker group SPG51 including the drive speakers regarding the listener LSN41. Further, the drive speaker selection section 22 selects three speakers that are present at the front of a listener LSN42 and are arrayed in the x direction as a speaker group SPG52 including the drive speakers regarding the listener LSN42. Similarly, the drive speaker selection section 22 selects a speaker group SPG53 for a listener LSN43 and selects a speaker group SPG54 for the listener LSN44.

As described above, the number of the drive speakers used in each listener is determined in accordance with the number of listeners. By doing so, even if the number of listeners is large, sound reproduced to each listener can be suppressed from interfering with each other.

Particularly, in this example, the selection of the drive speaker is performed so that as the listeners in the listening area are larger, the number of the drive speakers per listener becomes smaller, that is, the number of the drive speakers selected regarding the listener becomes smaller. The above case is also in the similar manner as in a case in which the drive speaker is selected in each group (listener group) including the plurality of listeners. As the number of the groups is larger, the number of the drive speakers selected regarding the group becomes smaller.

Note that, which speaker to select as the drive speaker can be determined, for example, by using a method described with reference to FIGS. 5 and 6.

Further, for example, a method for determining the number of the drive speakers on the basis of the number of the listeners as described with reference to FIG. 8 may be used in combination with a method described with reference to FIG. 7. In such a case, a rate (ratio) of the number of the drive speakers in each listener is determined, for example, on the basis of a ratio of a distance in the y direction from the speaker array 25 to each listener. Further, a speaker of the speaker array 25 is assigned to any one person of the listeners in accordance with the rate of the number of the drive speakers. Alternatively, the drive speaker used in each listener is determined so that the same speaker is not assigned to any listener, that is, the same speaker is not assigned to the plurality of listeners.

Note that, since a distance in the x direction between both of the listeners may be short, the same speaker may be used as the drive speaker of listeners different from each other. However, when a single speaker is preferably used as the drive speaker of a single listener, a suppression effect of an interference with sound can be improved.

Further, when selecting the drive speaker, the forming system information may be arbitrarily used in addition to the listener positional information. In other words, the drive speaker may be selected in accordance with the formation system of the sound field indicated by the forming system information.

For example, a specific forming method of the sound field indicated by the forming system information, that is, a sound field formation system includes a method using directivity control based on a delay sum or the like, a method for generating a focus sound source by using a WFS (Wave Field Synthesis) or an SDM (Spectral Division Method), a method for generating an evanescent wave, and the like.

For example, in the case where a highly directional sound field is formed toward a direction of the listener by using the directivity control, a speaker at the front of the listener is not necessarily used as the drive speaker.

Therefore, for example, in the case where the drive speaker is selected by using a method described with reference to FIG. 7, FIG. 8, or the like described above, the drive speaker selection section 22 may not select the same speaker as the drive speaker of each listener when forming the sound field by using the directivity control. That is, for example, a speaker at the front of each listener is assumed to be the drive speaker. When a single speaker is used as the drive speaker of the plurality of listeners, a speaker in a position deviated from the front of each listener is selected as the drive speaker. Thereby, such a drive speaker can be prevented from overlapping.

Further, for example, in the case where an evanescent wave is generated to thereby form the sound field, the speaker at the front of the listener needs to be selected as the drive speaker.

Consequently, for example, the drive speaker is selected by using a method described with reference to FIG. 5, FIG. 6, or the like described above. In such a case, when the sound field is formed by generating an evanescent wave, the drive speaker selection section 22 may permit the same speaker to be selected as the drive speaker of the plurality of listeners and select the drive speaker of each listener.

Further, in the case where the sound field is formed, for example, by using the SDM, the sound field can be formed by using speakers relatively less than those of other methods.

Consequently, for example, the drive speaker is selected by using a method described with reference to FIGS. 5 through 8, or the like. In such a case, when the sound field is formed by using the SDM, the drive speaker selection section 22 may select the drive speaker of each listener so that the same speaker is not selected as the drive speaker of the plurality of listeners.

Note that, a method for selecting the drive speaker is not limited to examples described above. When the drive speaker is selected by using at least the listener positional information, any method may be used. For example, respective methods described above may be arbitrarily combined, or the like.

(Acoustic Filter Coefficient Recording Section)

The acoustic filter coefficient recording section 23 determines a filter coefficient used to generate the speaker drive signal from among the filter coefficients of a previously prepared acoustic filter.

Specifically, the acoustic filter coefficient recording section 23 supplies only the filter coefficient of the drive speaker indicated by the drive speaker information supplied from the drive speaker selection section 22 among the filter coefficients of the acoustic filter for forming the sound field by using a method indicated by the forming system information to the acoustic filter section 24.

For example, the sound field forming method indicated by the forming system information is assumed to be the SDM. In such a case, the acoustic filter coefficient recording section 23 supplies only the filter coefficient of the drive speaker indicated by the drive speaker information among the filter coefficients of each of the speakers configuring the speaker array 25 used by the SDM to the acoustic filter section 24. The acoustic filter coefficient recording section 23 selects the filter coefficient on the basis of the forming system information and the drive speaker information in each listener and supplies the selected filter coefficient to the acoustic filter section 24.

Here, the filter coefficient of the acoustic filter used in the SDM is found out, for example, as described below. Note that, the SDM is described in detail, for example, in "Sascha Spors and Jens Ahrens, "Reproduction of Focused Sources by the Spectral Division Method", 4th International Symposium on Communication, Control and Signal Processing (ISCCSP), 2010." or the like.

For example, the sound field $P(v, n_{tf})$ in a three-dimensional free space is represented by the following Formula (1).

[Mathematical Formula 1]

$$P(v,n_{tf})=\int_{-\infty}^{\infty}D(v_0,n_{tf})G(v,v_0,n_{tf})dx_0 \quad (1)$$

Note that, in formula (1), $n_{tf}$ represents a time frequency index, v is a vector indicating a position in a space, and v=(x, Y, z) holds. Further, in formula (1), $v_0$ is a vector indicating a predetermined position in the x-axis and $v_0=(x_0, 0, 0)$ holds. Note that, hereinafter, it is assumed that a position indicated by the vector v is also referred to as the position v and a position indicated by the vector $v_0$ is also referred to as a position $v_0$.

Further, in formula (1), $D(v_0, n_{tf})$ represents a drive signal of a secondary sound source and $G(v, v_0, n_{tf})$ is a transfer function between the position v and the position $v_0$. A drive signal $D(v_0, n_{tf})$ of the secondary sound source corresponds to the speaker drive signal of the speakers configuring the speaker array 25.

In the calculation of formula (1) described above, convolution of the drive signal $D(v_0, n_{tf})$ and the transfer function $G(v, v_0, n_{tf})$ is formed in a spatial domain. Further, when a spatial Fourier transform is performed on the sound field $P(v, n_{tf})$ represented by formula (1) in the x-axis direction, the sound field is represented by the following formula (2).

[Mathematical Formula 2]

$$P_F(n_{sf},y,z,n_{tf})=D_F(n_{sf},n_{tf})G_F(n_{sf},y,z,n_{tf}) \quad (2)$$

Note that, in formula (2), $n_{sf}$ represents a spatial frequency index.

As described above, when the spatial Fourier transform is performed on the sound field $P(v, n_{tf})$, the sound field $P_F(n_{sf}, y, z, n_{tf})$ in a spatial frequency domain is represented by a product of a drive signal $D_F(n_{sf}, n_{tf})$ and a transfer function $G_F(n_{sf}, y, z, n_{tf})$ in the spatial frequency domain as represented by formula (2). Accordingly, a spatial frequency expression of the drive signal of the secondary sound source is represented by the following formula (3).

[Mathematical Formula 3]

$$D_F(n_{sf}, n_{tf}) = \frac{P_F(n_{sf}, y, z, n_{tf})}{G_F(n_{sf}, y, z, n_{tf})} \quad (3)$$

Further, in the case where the secondary sound source on a straight line is used, the sound field on a control point parallel to the straight line, namely, practically formed only on the reference line can be allowed to coincide with an ideal sound field. Consequently, a position in the y direction of the control point is set to $y=y_{ref}$, and since the sound field is considered to be formed on a horizontal surface, a position in the z direction thereof is set to z=0. Formula (3) is represented by the following formula (4).

[Mathematical Formula 4]

$$D_F(n_{sf}, n_{tf}) = \frac{P_F(n_{sf}, y_{ref}, 0, n_{tf})}{G_F(n_{sf}, y_{ref}, 0, n_{tf})} \quad (4)$$

The drive signal $D_F(n_{sf}, n_{tf})$ of the secondary sound source represented by the above formula (4) is a drive signal for forming an ideal sound field in the control point with the position of $y=y_{ref}$ set to the control point.

Further, a point sound source model $P_{ps}(n_{sf}, y_{ref}, 0, n_{tf})$ can be used, for example, as a desired sound field $P_F(n_{sf}, y_{ref}, 0, n_{tf})$ as represented by the following formula (5).

[Mathematical Formula 5]

$$P_{ps}(n_{sf}, y_{ref}, 0, n_{tf}) = S(n_{tf}) \times e^{jk_x x_{ps}} \times \begin{cases} -\frac{j}{4}H_0^{(2)}\left(\sqrt{\left(\frac{\omega}{c}\right)^2 - k_x^2}\,(y_{ref} - y_{ps})\right), & |k_x| < \left|\frac{\omega}{c}\right| \\ \frac{1}{2\pi}K_0\left(\sqrt{k_x^2 - \left(\frac{\omega}{c}\right)^2}\,(y_{ref} - y_{ps})\right), & \left|\frac{\omega}{c}\right| < |k_x| \end{cases} \quad (5)$$

Note that, in formula (5), $S(n_{tf})$ represents a sound source signal of sound to be reproduced, j represents an imaginary unit, and $k_x$ represents a wavenumber in the x-axis direction. In addition, $x_{ps}$ and $y_{ps}$ represent an x coordinate and y coordinate that indicate a position of the point sound source, respectively, ω represents an angular frequency, and c represents sound speed. Further, $H_0^{(2)}$ represents a Hankel function of the second kind and $K_0$ represents a Bessel function. Note that, the filter coefficient does not depend on the sound source, and therefore is here set to $S(n_{tf})=1$.

Further, a transfer function $G_F(n_{sf}, y_{ref}, 0, n_{tf})$ can be represented by the following formula (6).

[Mathematical Formula 6]

$$G_F(n_{sf}, y_{ref}, 0, n_{tf}) = \begin{cases} -\frac{j}{4}H_0^{(2)}\left(\sqrt{\left(\frac{\omega}{c}\right)^2 - k_x^2}\,y_{ref}\right), & |k_x| < \left|\frac{\omega}{c}\right| \\ \frac{1}{2\pi}K_0\left(\sqrt{k_x^2 - \left(\frac{\omega}{c}\right)^2}\,y_{ref}\right), & \left|\frac{\omega}{c}\right| < |k_x| \end{cases} \quad (6)$$

Formulas (4), (5), and (6) described above are used and a spatial frequency spectrum $D_F(n_{sf}, n_{tf})$ of the speaker drive signal of the speaker array 25 is found out.

Next, a spatial frequency synthesis is performed on the spatial frequency spectrum $D_F(n_{sf}, n_{tf})$ by using a DFT (Discrete Fourier Transform) to thereby find out a time-frequency spectrum $D(l, n_{tf})$. Specifically, the following formula (7) is calculated and thereby the time-frequency spectrum $D(l, n_{tf})$ is calculated.

[Mathematical Formula 7]

$$D(l, n_{tf}) = \sum_{n_{sf}=0}^{M_{ds}-1} D_F(n_{sf}, n_{tf})e^{-j\frac{2\pi l n_{sf}}{M_{ds}}} \quad (7)$$

Note that, in formula (7), l identifies the speakers configuring the speaker array 25 and represents a speaker index indicating a position in the x direction of the speaker. Further, $M_{ds}$ represents the number of samples of the DFT.

Further, a time-frequency synthesis is performed on the time-frequency spectrum $D(l, n_{tf})$ by using an IDFT (Inverse Discrete Fourier Transform). Further, a speaker drive signal $d(l, n_d)$ of each of the speakers configuring the speaker array 25, which is a time signal, is found out. Specifically, the following formula (8) is calculated and thereby the speaker drive signal $d(l, n_d)$ is calculated.

[Mathematical Formula 8]

$$d(l, n_d) = \frac{1}{M_{dt}} \sum_{n_{tf}=0}^{M_{dt}-1} D(l, n_{tf}) e^{j\frac{2\pi n_d n_{tf}}{M_{dt}}} \tag{8}$$

Note that, in formula (8), $n_d$ represents a time index and $M_{dt}$ represents the number of samples of the IDFT.

The speaker drive signal d(l, $n_d$) that is found out as described above represents the filter coefficient itself that does not depend on the sound source. Consequently, a time index $n_d$ of the speaker drive signal d(l, $n_d$) is replaced with a time index n. The replaced time index n is set to a filter coefficient h(l, n) of the acoustic filter that is found out in a position ($x_{ps}$, $y_{ps}$) of the point sound source and a position $y=y_{ref}$ of the control point.

Here, regarding a single control point, the filter coefficient h(l, n) is found out in each speaker identified by a speaker index l of the speaker array 25. That is, the acoustic filter is configured by the filter coefficient h(l, n) for each of the speakers configuring the speaker array 25.

According to need, the filter coefficient h(l, n) described above is found out in each position ($x_{ps}$, $y_{ps}$) of the point sound source and in each position of the control point and is recorded in the acoustic filter coefficient recording section 23.

Further, for example, the filter coefficient of the acoustic filter used at the time of forming the sound field by generating an evanescent wave is found out, for example, as described below. Note that, a method for forming the sound field by using an evanescent wave is described in detail, for example, in "Itou et al. "EVANESCENT WAVE REPRODUCTION USING LINEAR ARRAY OF LOUDSPEAKERS," in IEEE Workshop on Applications of Signal Processing to Audio and Acoustics (WASPAA), 2011." or the like.

In the three-dimensional free space, for example, the sound field p(v, t) at a time t in a given position v satisfies a wave equation represented by the following formula (9).

[Mathematical Formula 9]

$$\nabla^2 p(v, t) - \frac{1}{c^2}\frac{\partial^2 p(v, t)}{\partial t^2} = 0 \tag{9}$$

Note that, in formula (9), c represents a sound speed and $\nabla^2$ is as represented by the following formula (10).

[Mathematical Formula 10]

$$\nabla^2 = \frac{\partial^2}{\partial x^2} + \frac{\partial^2}{\partial y^2} + \frac{\partial^2}{\partial z^2} \tag{10}$$

Further, an inverse time Fourier transform T(t) is assumed to be represented by the following formula (11). At this time, a time Fourier transform F(•) is represented by the following formula (12).

[Mathematical Formula 11]

$$T(t) = \frac{1}{2\pi}\int_{-\infty}^{\infty} \overline{T}(\omega) e^{j\omega t} d\omega \tag{11}$$

[Mathematical Formula 12]

$$F\left(\frac{\partial^2 T(t)}{\partial t^2}\right) = (j\omega)^2 \overline{T}(\omega) \tag{12}$$

Note that, in formula (11) and formula (12), j represents an imaginary unit and ω represents an angular frequency.

Here, by performing variable separation, formula (9) described above is separated into differentiation in a space and differentiation in a time as represented by the following formula (13). Further, when using formula (12), a Helmholtz equation represented by the following formula (14) is obtained.

[Mathematical Formula 13]

$$p(v,t)=X(v)T(t) \tag{13}$$

[Mathematical Formula 14]

$$\nabla^2 P(v, \omega) + \left(\frac{\omega}{c}\right)^2 P(v, \omega) = 0 \tag{14}$$

Note that, in formula (14), P(v, ω) represents the sound field of an angular frequency ω in the position v. Further, an angular frequency is $\omega_{pw}$ and wavenumbers in the x direction, in the y direction, and in the z direction are $k_{pw,x}$, $k_{pw,y}$, and $k_{pw,z}$, respectively. At this time, a plane wave that propagates in a direction indicated by the angular frequency $\omega_{pw}$, the wavenumber $k_{pw,x}$, the wavenumber $k_{pw,y}$, and the wavenumber $k_{pw,z}$ is represented by formula 15. Further, a general solution of the Helmholtz equation represented by formula (14) is represented by the following formula (15).

[Mathematical Formula 15]

$$P(v,\omega)=2\pi\delta(\omega-\omega_{pw})e^{-j(k_{pw,x}x+k_{pw,y}y+k_{pw,z}z)} \tag{15}$$

Note that, in formula (15), $\delta(\omega-\omega_{pw})$ represents a delta function.

Here, a relationship represented by the following formula (16) holds in a wavenumber domain.

[Mathematical Formula 16]

$$\left(\frac{\omega}{c}\right)^2 = k_{pw,x}^2 + k_{pw,y}^2 + k_{pw,z}^2 \tag{16}$$

When formula (16) is solved regarding the wavenumber $k_{pw,y}$ in the y direction, it is represented by the following formula (17).

[Mathematical Formula 17]

$$k_{pw,y} = \begin{cases} \pm\sqrt{\left(\frac{\omega}{c}\right)^2 - k_{pw,x}^2 - k_{pw,z}^2} & \text{for } \sqrt{k_{pw,x}^2 + k_{pw,z}^2} < \left|\frac{\omega}{c}\right| \\ \pm j\sqrt{k_{pw,x}^2 + k_{pw,z}^2 - \left(\frac{\omega}{c}\right)^2} & \text{for } \left|\frac{\omega}{c}\right| < \sqrt{k_{pw,x}^2 + k_{pw,z}^2} \end{cases} \tag{17}$$

A wave of the wavenumber $k_{pw,y}$ indicated in an upper stage, namely, in the upper side of the above formula (17) indicates a normal propagating wave, whereas a wave of the wavenumber $k_{pw,y}$ indicated in a lower stage, namely, in the lower side of the above formula (17) indicates an evanescent wave.

Consequently, when the wavenumber $k_{pw,y}$ of the evanescent wave indicated in the lower stage of formula (17) is substituted in the sound field P(v, ω) represented by formula (15), formula (15) is represented by the following formula (18).

[Mathematical Formula 18]

$$P(v, \omega) = 2\pi\delta(\omega - \omega_{pw})e^{-\sqrt{k_{pw,x}^2 + k_{pw,z}^2 - \left(\frac{\omega}{c}\right)^2}\, y} e^{-j(k_{pw,x}x + k_{pw,z}z)} \tag{18}$$

Note, however, that when the wavenumber $k_{pw,y}$ is substituted in formula (15), a term in which a sign of the wavenumber $k_{pw,y}$ is positive is a solution having no physical meaning, and therefore a term in which a sign is negative is substituted therein.

Further, $(k_{pw,x}^2 + k_{pw,z} - (\omega/c)^2)^{1/2}$ in expression represented by formula (18) is a term in which a size of an attenuation of the evanescent wave is determined.

Accordingly, for example, the evanescent wave is desired to have a size of a constant attenuation without depending on the angular frequency ω. In such a case, using a fixed number α indicating a size of the attenuation, the wavenumber $k_{pw,x}$ and the wavenumber $k_{pw,y}$ just have to be set so as to satisfy the following formula (19). At this time, it can be understood from formula (18) that as the fixed number α is larger, a rate of decrease of the evanescent wave becomes larger.

[Mathematical Formula 19]

$$\alpha = \sqrt{k_{pw,x}^2 + k_{pw,z}^2 - \left(\frac{\omega}{c}\right)^2} \tag{19}$$

Here, the filter coefficient of the acoustic filter for obtaining the speaker drive signal that generates the evanescent wave represented by formula (18) is considered to be found out.

When the spatial Fourier transform is performed on formula (18) regarding x, formula (18) is represented by the following formula (20).

[Mathematical Formula 20]

$$P'(k_x, y, z, \omega) = 4\pi^2\delta(\omega - \omega_{pw})\delta(k_x - k_{pw,x})e^{-\alpha y}e^{-jk_{pw,z}z} \tag{20}$$

Further, a spatial frequency spectrum G' ($k_x$, y, z, (ω) of the transfer function is represented by the following formula (21).

[Mathematical Formula 21]

$$G'(k_x, y, z, \omega) = \begin{cases} -\frac{j}{4}H_0^{(2)}\left(\sqrt{\left(\frac{\omega}{c}\right)^2 - k_x^2}\,\sqrt{y^2 + z^2}\right) & \text{for } |k_x| \leqq \left|\frac{\omega}{c}\right| \\ \frac{1}{2\pi}K_0\left(\sqrt{k_x^2 - \left(\frac{\omega}{c}\right)^2}\,\sqrt{y^2 + z^2}\right) & \text{for } |k_x| > \left|\frac{\omega}{c}\right| \end{cases} \tag{21}$$

Note that, in formula (21), $H_0^{(2)}$ represents a Hankel function of the second kind and $K_0$ represents a Bessel function.

Further, using formula (20) and formula (21), a spatial frequency spectrum D'($k_x$, ω) of the speaker drive signal is represented by the following formula (22) through the SDM.

[Mathematical Formula 22]

$$D'(k_x, \omega) = \frac{8\pi^3 e^{-\alpha y_{ref}} e^{-jk_{pw,z}z}}{K_0(\alpha y_{ref})}\delta(\omega - \omega_{pw})\delta(k_x - k_{pw,x}) \tag{22}$$

In formula (22), $y_{ref}$ represents a position of the control point based on the y direction.

An inverse spatial Fourier transform is performed on formula (22) obtained as described above regarding the wavenumber $k_x$, and thereby a time-frequency spectrum D(x, ω) of the speaker drive signal represented by the following formula (23) is obtained.

[Mathematical Formula 23]

$$D(x, \omega) = \frac{4\pi^2 e^{-\alpha y_{ref}} e^{-jk_{pw,z}z}}{K_0(\alpha y_{ref})}e^{-jk_{pw,x}x}\delta(\omega - \omega_{pw}) \tag{23}$$

Further, when an inverse time Fourier transform is performed on the time-frequency spectrum D(x, ω) obtained as described above, a time wave form d(x, t) of the speaker drive signal, namely, a speaker drive signal d(x, t) that is a time signal is found out as represented by the following formula (24).

[Mathematical Formula 24]

$$d(x, t) = \frac{2\pi e^{-\alpha y_{ref}} e^{-jk_{pw,z}z}}{K_0(\alpha y_{ref})}e^{-jk_{pw,x}x}e^{-j\omega_{pw}t} \tag{24}$$

At this time, the speakers configuring the speaker array 25 are identified and an index indicating a position in the x direction of the speaker is set to l. Then, as represented by formula (25) described below, the filter coefficient h(l, n) of the speaker of the speaker index l of the acoustic filter is found out from formula (24).

[Mathematical Formula 25]

$$h(l, n) = \frac{2\pi e^{-\alpha y_{ref}} e^{-jk_{pw,z}z}}{K_0(\alpha y_{ref})}e^{-jk_{pw,x}l}e^{-j\omega_{pw}n} \tag{25}$$

Note that, in formula (25), n represents a time index. Here, x in the speaker drive signal d(x, t) represented by formula (24) is replaced with the speaker index l, and at the same time, t is replaced with the time index n and thereby the filter coefficient h(l, n) is obtained. The filter coefficient h(l, n) obtained as described above is recorded in advance in the acoustic filter coefficient recording section 23.

Further, in the above, a method for finding out the evanescent wave in the wavenumber domain and calculating the filter coefficient h(l, n) is described. Further, the filter coefficient that generates the evanescent wave may be found out by using a method other than the above method.

As described above, the filter coefficient such as the filter coefficient used for the SDM or the filter coefficient for forming the sound field through the evanescent wave is recorded in the acoustic filter coefficient recording section 23 in a method or in each of the plurality of methods for forming the sound field.

(Acoustic Filter Section)

A sound source signal x(n) of sound to be reproduced is supplied to the acoustic filter section 24. Here, n of the sound source signal x(n) represents a time index.

The acoustic filter section 24 convolutes the supplied sound source signal x(n) and the filter coefficient h(l, n) supplied from the acoustic filter coefficient recording section 23 to find out a speaker drive signal d(l, n). Specifically, in the acoustic filter section 24, a calculation of the following formula (26) is performed in each drive speaker of the speakers configuring the speaker array 25. Then, the speaker drive signal d(l, n) of each drive speaker identified by the speaker index 1 is calculated.

[Mathematical Formula 26]

$$d(l, n) = \sum_{k=0}^{N} h(l, k) \times (n - k) \tag{26}$$

Note that, in formula (26), N represents a filter length of the acoustic filter.

Further, in the drive speaker selection section 22, a drive speaker is selected in each listener. In this case, the filter coefficient h(l, n) of the acoustic filter is supplied to each listener from the acoustic filter coefficient recording section 23. In such a case, the acoustic filter section 24 finds out the speaker drive signal d(l, n) of each drive speaker in each listener to find out the final speaker drive signal. At this time, for example, in the case where a single speaker is set to the drive speaker of the plurality of listeners, the speaker drive signal of each listener calculated regarding the speaker is added and set to the final speaker drive signal.

The acoustic filter section 24 supplies the final speaker drive signal obtained as described above to the speaker array 25

<Descriptions of Sound Field Forming Processing>

Figure 9:
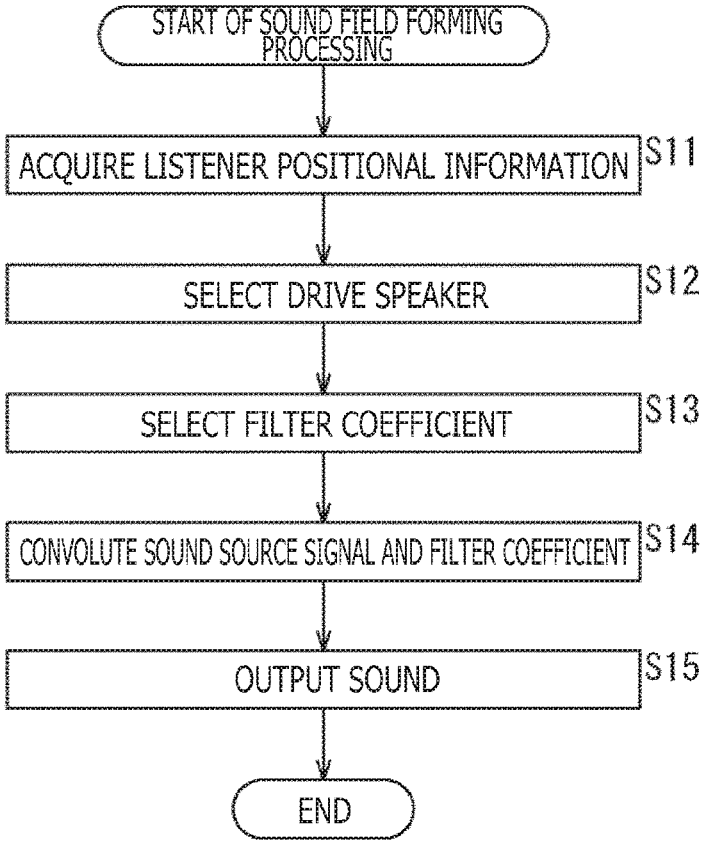
FIG. 9 is a flowchart describing sound field forming processing.

Next, operations of the sound field forming apparatus 11 described above will be described. Specifically, hereinafter, sound field forming processing performed by the sound field forming apparatus 11 will be described with reference to a flowchart illustrated in FIG. 9.

At step S11, the listener position acquisition section 21 acquires the listener positional information and supplies it to the drive speaker selection section 22.

At step S11, for example, information indicating a position of each listener in the listening area, which is supplied from an external apparatus or input from the user etc., is acquired as the listener positional information. Further, for example, a position of a listener may be found out from an object recognition for an image photographed by a camera as the listener position acquisition section 21, a detection of a listener performed by a pressure sensing sensor as the listener position acquisition section 21, or the like.

At step S12, the drive speaker selection section 22 selects the drive speaker of each listener on the basis of the listener positional information supplied from the listener position acquisition section 21 and the forming system information supplied from the outside. Further, the drive speaker selection section 22 generates the drive speaker information indicating selection results thereof.

At step S12, for example, the drive speaker is selected for each listener by using a method etc. described with reference to FIGS. 5 to 8 or the like. The drive speaker selection section 22 supplies the drive speaker information generated by selecting the drive speaker to the acoustic filter coefficient recording section 23.

At step S13, the acoustic filter coefficient recording section 23 selects the filter coefficient in each listener from among a plurality of filter coefficients recorded in advance on the basis of the forming system information supplied from the outside and the drive speaker information supplied from the drive speaker selection section 22 and supplies it to the acoustic filter section 24. At this time, regarding each listener, the acoustic filter coefficient recording section 23 selects only the filter coefficient of the drive speaker indicated by the drive speaker information from among the filter coefficients of all the speakers configuring the speaker array 25 used by the sound field forming method indicated by the forming system information and supplies it to the acoustic filter section 24.

At step S14, regarding each listener, the acoustic filter section 24 convolutes the sound source signal supplied from the outside and the filter coefficient supplied from the acoustic filter coefficient recording section 23 and finds out the speaker drive signal. Further, the acoustic filter section 24 obtains the final speaker drive signal from the speaker drive signal found out in each listener.

Specifically, at step S14, a calculation of formula (26) described above is performed and the speaker drive signal of each speaker is calculated. Further, according to need, the speaker drive signal for each listener of the same speaker is added and the final speaker drive signal is generated.

Specifically, for example, regarding a speaker selected as the drive speaker of only a single listener from among the speakers configuring the speaker array 25, the speaker drive signal found out regarding the speaker is directly set to the final speaker drive signal.

By contrast, regarding a speaker selected as the drive speaker of the plurality of listeners from among the speakers configuring the speaker array 25, a sum of the speaker drive signals found out in each listener regarding the speaker is set to the final speaker drive signal. Further, regarding a speaker that is not selected as the drive speaker, the speaker drive signal of the speaker may be set to, for example, a silence signal. Alternatively, the speaker drive signal itself may be set so as not to be generated.

When generating the speaker drive signal of each of the speakers configuring the speaker array 25, the acoustic filter section 24 supplies the obtained speaker drive signal to the speaker array 25.

At step S15, the speaker array 25 outputs sound and forms a desired sound field on the basis of the speaker drive signal supplied from the acoustic filter section 24. Then, the sound field forming processing ends.

As described above, the sound field forming apparatus 11 acquires the listener positional information and selects the drive speaker on the basis of the listener positional information and the forming system information. Further, the sound field forming apparatus 11 performs the convolution processing by using only the filter coefficient of the selected drive speaker and generates the speaker drive signal.

By doing so, an appropriate speaker can be selected in each listener from among the speakers configuring the speaker array 25 and a formation of the sound field can be performed. Further, interference with the sound reproduced in each listener can be suppressed and the reproducibility of the wave front of sound can be improved. Further, the convolution operation only regarding the drive speaker just has to be performed in each listener. Therefore, the reproducibility of the wave front can be improved by using the smaller amount of computation.

Further, the point sound source is formed in a position of a listener by using the sound field forming apparatus 11. In such a case, when the listener moves to other position with time, a position of the point sound source can be moved while following on movements of the listener on the basis of the listener positional information changing in real time. In a movement of the point sound source, for example, a position of the speaker selected as the drive speaker is moved in accordance with the movement of the listener. Through the process, that is, the drive speaker is reselected on the basis of a position of the listener after the movement to thereby realize the formation of the point sound source.

Further, an example in which the selection of the drive speaker is performed in each listener is described as described above. Further, in the case where the plurality of listeners exist near to each other, or the like, the plurality of listeners may be set to a single group and processing may be performed in units of groups. In such a case, in each group, the drive speaker may be selected and the convolution of the sound source signal and the filter coefficient may be performed.

When the listeners are grouped, for example, the plurality of listeners in which a mutual distance is shorter than a constant distance that is determined in advance may be handled as a single group. Alternatively, the listeners may be grouped by using other methods.

At the time of forming the sound field, for example, the speaker drive signal may be generated so that directivity of sound that is output from the speaker array 25 toward a domain of the group is widened in accordance with a size of the group including the plurality of listeners, namely, a size of a domain containing the listeners belonging to the group. That is, for example, a width in the x direction and in the y direction of the domain in which sound is heard through directivity control may be changed.

Further, at a group including the plurality of listeners, for example, a new listener is assumed to move and arrive from the outside of the group. In such a case, processing may be performed as a new group to which the listener is added. By contrast, a listener that exists in the group is assumed to move and be separated from the group that is already present. In such a case, processing may be performed as a new group from which the listener is excluded.

Further, for example, the sound field forming apparatus 11 is applicable also to a system etc. that is reproduced by switching a content in accordance with a nationality of listeners, namely, a used language. In such a case, for example, using nationality information of a listener in the listening area, a content that the listener is allowed to hear just has to be switched. At this time, the nationality information of the listener may be acquired, for example, from an electronic passport or the like possessed by the listener. Alternatively, it may be acquired by using other methods.

<Configuration Example of Computer>

The series of above-described processing can be executed by hardware or by software. In a case where the series of processing is executed by software, a program included in the software is installed into a computer. Here, the computer may be a computer embedded in special hardware or may be, for example, a general personal computer which can execute various functions by installation of various programs.

Figure 10:
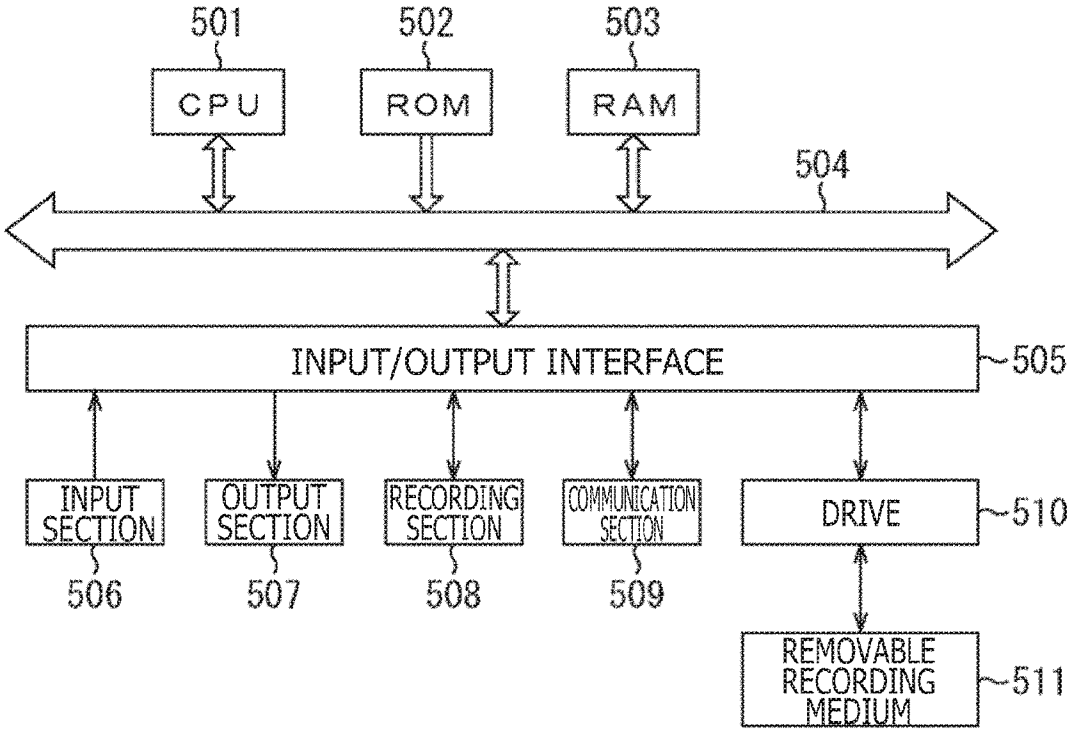
FIG. 10 is a diagram illustrating a configuration example of a computer.

FIG. 10 is a block diagram illustrating a configuration example of hardware of a computer to execute the series of above-described processing by a program.

In the computer, a CPU (Central Processing Unit) 501, a ROM (Read Only Memory) 502, and a RAM (Random Access Memory) 503 are connected to each other via a bus 504.

To the bus 504, an input/output interface 505 is further connected. To the input/output interface 505, an input section 506, an output section 507, a recording section 508, a communication section 509, and a drive 510 are connected.

The input section 506 includes a keyboard, a mouse, a microphone, an image pickup device, or the like. The output section 507 includes a display, a speaker array, or the like. The recording section 508 includes a hard disk, a nonvolatile memory, or the like. The communication section 509 includes a network interface or the like. The drive 510 drives a removable recording medium 511 such as a magnetic disk, an optical disk, a magneto optical disk, or a semiconductor memory.

In the computer configured as described above, the CPU 501 loads, for example, a program recorded in the recording section 508 into the RAM 503 through the input/output interface 505 and the bus 504 and executes the program, and thereby the series of above-described processing is performed.

For example, the program executed by the computer (CPU 501) is recorded in the removable recording medium 511, which functions as a package medium or the like, when being provided. Also, the program can be provided through a wired or wireless transmission medium such as a local area network, the Internet, or a digital satellite broadcast.

In the computer, by mounting the removable recording medium 511 to the drive 510, the program can be installed into the recording section 508 through the input/output interface 505. Also, the program can be received in the communication section 509 through the wired or wireless transmission medium and can be installed into the recording section 508. In addition, the program can be previously installed into the ROM 502 or the recording section 508.

Note that, the program executed by the computer may be a program in which processing is performed chronologically in an order described in this specification or may be a program in which processing is performed in parallel or at necessary timing such as when a call is performed.

Further, an embodiment of the present technology is not limited to the above embodiments, and various changes can be made within a scope not departing from the gist of the present technology.

For example, the present technology may have a cloud computing configuration in which one function is shared and jointly processed by a plurality of apparatuses via a network.

The steps described above with reference to the above-described flowchart may be performed by a single apparatus or may be shared and performed by a plurality of apparatuses.

Further, in the case where a plurality of processes are included in a single step, the plurality of processes included in the single step may be performed by a single apparatus or may be shared and performed by a plurality of apparatuses.

Incidentally, the advantageous effects described in this specification are strictly illustrative and are not limited thereto, and there may be advantageous effects other than those described in this specification.

Further, the present technology may also take the following configurations.

(1) A sound field forming apparatus including:

a listener position acquisition section configured to acquire listener positional information indicating a position of a listener;

a drive speaker selection section configured to select one or a plurality of speakers, as a drive speaker, used to form a sound field, among the speakers configuring a speaker array on the basis of the listener positional information; and a drive signal generation section configured to drive the drive speaker and generate a speaker drive signal for forming the sound field in accordance with a selection result of the drive speaker.

(2) The sound field forming apparatus according to (1), in which the speaker drive signal is a signal for forming the sound field by wave front synthesis.

(3) The sound field forming apparatus according to (1) or (2), in which the drive signal generation section convolutes a filter coefficient and a sound source signal and generates the speaker drive signal only regarding the drive speaker of the speakers configuring the speaker array.

(4) The sound field forming apparatus according to (3), further including a filter coefficient recording section configured to record the filter coefficient of each of the speakers configuring the speaker array.

(5) The sound field forming apparatus according to any one of (1) to (4), in which the drive speaker selection section selects a speaker positioned near to the listener as the drive speaker in a direction parallel to the speaker array.

(6) The sound field forming apparatus according to any one of (1) to (5), in which the drive speaker selection section selects a speaker positioned near to a sound source generated by forming the sound field as the drive speaker in a direction parallel to the speaker array.

(7) The sound field forming apparatus according to any one of (1) to (6), in which the drive speaker selection section selects the drive speaker so that as the listener exists in a position more distant from the speaker array, the number of the drive speakers becomes larger in a direction vertical to the speaker array.

(8) The sound field forming apparatus according to any one of (1) to (7), in which the drive speaker selection section selects the drive speaker so that as the number of the listeners or listener groups is larger, the number of the drive speakers that are selected regarding the listener or the listener group becomes smaller in the case where the drive speaker is selected in each of the listeners or in each of the listener groups.

(9) The sound field forming apparatus according to any one of (1) to (8), in which the drive speaker selection section selects the drive speaker in accordance with a forming system of the sound field.

(10) A sound field forming method including the steps of:

acquiring listener positional information indicating a position of a listener;

selecting one or a plurality of speakers, as a drive speaker, used to form a sound field, among the speakers configuring a speaker array on the basis of the listener positional information; and driving the drive speaker and generating a speaker drive signal for forming the sound field in accordance with a selection result of the drive speaker.

(11) A program for causing a computer to execute a process including the steps of:

acquiring listener positional information indicating a position of a listener;

selecting one or a plurality of speakers, as a drive speaker, used to form a sound field, among the speakers configuring a speaker array on the basis of the listener positional information; and driving the drive speaker and generating a speaker driving signal for forming the sound field in accordance with a selection result of the drive speaker.

REFERENCE SIGNS LIST

11 Sound field forming apparatus
21 Listener position acquisition section
22 Drive speaker selection section
23 Acoustic filter coefficient recording section
24 Acoustic filter section
25 Speaker array

The invention claimed is:

1. A sound field forming apparatus, comprising:

a listener position acquisition section configured to acquire listener positional information indicating a position of a listener;

a drive speaker selection section configured to:

select a first set of speakers of a plurality of speakers, as a drive speaker, based on the listener positional information, wherein the plurality of speakers forms a speaker array, and among the plurality of speakers, the selected first set of speakers is nearest to the listener in a first direction parallel to a second direction in which the plurality of speakers of the speaker array is arrayed; and increase a number of speakers in the first set of speakers selected as the drive speaker, wherein the increase of the number of speakers is based on an increase in a distance of the listener from the speaker array in a third direction perpendicular to the second direction, and the drive speaker is configured to form a sound field based on a sound wave output from the drive speaker in the third direction perpendicular to the second direction; and a drive signal generation section configured to:

drive the drive speaker; and generate a speaker drive signal for the formation of the sound field, wherein the speaker drive signal is generated based on a selection result of the drive speaker.

2. The sound field forming apparatus according to claim 1, wherein the sound field is formed by wave front synthesis.

3. The sound field forming apparatus according to claim 1, wherein the drive signal generation section is further configured to:

convolute a specific filter coefficient of a plurality of filter coefficients and a sound source signal, wherein each of the plurality of filter coefficients corresponds to one of the plurality of speakers, and the specific filter coefficient corresponds to a specific speaker of the selected first set of speakers; and generate the speaker drive signal for the specific speaker of the selected first set of speakers based on the convolution.

4. The sound field forming apparatus according to claim 3, further comprising a filter coefficient recording section configured to record the plurality of filter coefficients of the plurality of speakers.

5. The sound field forming apparatus according to claim 1, wherein the drive speaker selection section is further configured to select a second set of speakers of the plurality of speakers as the drive speaker, the selected second set of speakers is nearest to a sound source in the first direction parallel to the second direction among the plurality of speakers, and generation of the sound source is based on the formation of the sound field.

6. The sound field forming apparatus according to claim 1, wherein based on an increase in one of a number of listeners or a number of listener groups, the drive speaker selection section is further configured to decrease the number of speakers in the first set of speakers selected as the drive speaker, and the first set of speakers is selected for one of each listener of the number of listeners or each listener group of the number of listener groups.

7. The sound field forming apparatus according to claim 1, wherein the drive speaker selection section is further configured to select the drive speaker based on a forming system of the sound field.

8. A sound field forming method, comprising:

in a sound field forming apparatus that includes a listener position acquisition section, a drive speaker selection section, and a drive signal generation section:

acquiring, by the listener position acquisition section, listener positional information indicating a position of a listener;

selecting, by the drive speaker selection section, a set of speakers of a plurality of speakers, as a drive speaker, based on the listener positional information, wherein the plurality of speakers forms a speaker array, and among the plurality of speakers, the selected set of speakers is nearest to the listener in a first direction parallel to a second direction in which the plurality of speakers of the speaker array is arrayed;

increasing, by the drive speaker selection section, a number of speakers in the set of speakers selected as the drive speaker, wherein the increase of the number of speakers is based on an increase in a distance of the listener from the speaker array in a third direction perpendicular to the second direction;

forming, by the drive speaker, a sound field based on a sound wave output from the drive speaker in the third direction perpendicular to the second direction;

driving the drive speaker by the drive signal generation section; and generating, by the drive signal generation section, a speaker drive signal for the formation of the sound field, wherein the speaker drive signal is generated based on a selection result of the drive speaker.

9. A non-transitory computer-readable medium having stored thereon computer-executable instructions which, when executed by a computer, cause the computer to execute operations, the operations comprising:

acquiring listener positional information indicating a position of a listener;

selecting a set of speakers of a plurality of speakers, as a drive speaker, based on the listener positional information, wherein the plurality of speakers forms a speaker array, and among the plurality of speakers, the selected set of speakers is nearest to the listener in a first direction parallel to a second direction in which the plurality of speakers of the speaker array is arrayed;

increasing a number of speakers in the set of speakers selected as the drive speaker, wherein the increase of the number of speakers is based on an increase in a distance of the listener from the speaker array in a third direction perpendicular to the second direction, and the drive speaker is configured to form a sound field based on a sound wave output from the drive speaker in the third direction perpendicular to the second direction;

driving the drive speaker; and generating a speaker driving signal for the formation of the sound field, wherein the speaker drive signal is generated based on a selection result of the drive speaker.

* * * * *